US009259622B2

(12) United States Patent
Tachibana et al.

(10) Patent No.: US 9,259,622 B2
(45) Date of Patent: Feb. 16, 2016

(54) GOLF BALL

(71) Applicant: DUNLOP SPORTS CO. LTD., Kobe-shi, Hyogo (JP)

(72) Inventors: Kosuke Tachibana, Kobe (JP); Kazuhiko Isogawa, Kobe (JP)

(73) Assignee: DUNLOP SPORTS CO. LTD., Kobe-shi (JP)

( * ) Notice: Subject to any disclaimer, the term of this patent is extended or adjusted under 35 U.S.C. 154(b) by 0 days.

(21) Appl. No.: 14/576,425

(22) Filed: Dec. 19, 2014

(65) Prior Publication Data

US 2015/0182803 A1 Jul. 2, 2015

(30) Foreign Application Priority Data

Dec. 27, 2013 (JP) ..... 2013-272803

(51) Int. Cl.
*A63B 37/06* (2006.01)
*A63B 37/00* (2006.01)

(52) U.S. Cl.
CPC ..... *A63B 37/0092* (2013.01); *A63B 37/0076* (2013.01); *A63B 37/0077* (2013.01); *A63B 37/008* (2013.01)

(58) Field of Classification Search
CPC ..... A63B 37/0031; A63B 37/0033; A63B 37/0076
USPC ..... 473/376
See application file for complete search history.

(56) References Cited

U.S. PATENT DOCUMENTS

| | | | | |
|---|---|---|---|---|
| 2012/0270678 | A1 | 10/2012 | Umezawa et al. | |
| 2012/0270679 | A1 | 10/2012 | Umezawa et al. | |
| 2012/0270680 | A1 | 10/2012 | Umezawa et al. | |
| 2012/0270681 | A1 | 10/2012 | Umezawa et al. | |
| 2013/0029787 | A1 * | 1/2013 | Watanabe | A63B 37/0031 473/373 |
| 2015/0119170 | A1 * | 4/2015 | Tachibana | A63B 37/0076 473/376 |
| 2015/0182808 | A1 * | 7/2015 | Tachibana | A63B 37/0092 473/376 |

* cited by examiner

*Primary Examiner* — Raeann Gorden
(74) *Attorney, Agent, or Firm* — Birch Stewart Kolasch & Birch, LLP

(57) ABSTRACT

A golf ball includes a core, a mid layer, and a cover. The core includes an inner core, a mid core, and an outer core. The mid layer includes an inner mid layer and an outer mid layer. A hardness H(C) is equal to or greater than a hardness H(B). A hardness H(E) is equal to or greater than a hardness H(D). An angle α is calculated by (Formula 1). An angle β is calculated by (Formula 2). The angle α is 0° or greater. A difference (α−β) is 0° or greater. A hardness Hm2 of the outer mid layer is less than a hardness Hm1 of the inner mid layer. A hardness Hc of the cover is less than the hardness Hm2.

$$\alpha=(180°/\pi)*a\tan[\{H(D)-H(C)\}/Y] \quad \text{(Formula 1)}$$

$$\beta=(180°/\pi)*a\tan[\{H(F)-H(E)\}/Z] \quad \text{(Formula 2)}$$

10 Claims, 2 Drawing Sheets

GOLF BALL

This application claims priority on Patent Application No. 2013-272803 filed in JAPAN on Dec. 27, 2013. The entire contents of this Japanese Patent Application are hereby incorporated by reference.

BACKGROUND OF THE INVENTION

1. Field of the Invention

The present invention relates to golf balls. Specifically, the present invention relates to golf balls that include a core, a mid layer, and a cover.

2. Description of the Related Art

Golf players' foremost requirement for golf balls is flight performance. In particular, golf players place importance on flight performance upon a shot with a driver. Flight performance correlates with the resilience performance of a golf ball. When a golf ball having excellent resilience performance is hit, the golf ball flies at a high speed, thereby achieving a large flight distance.

An appropriate trajectory height is required in order to achieve a large flight distance. A trajectory height depends on a spin rate and a launch angle. With a golf ball that achieves a high trajectory by a high spin rate, a flight distance is insufficient. With a golf ball that achieves a high trajectory by a high launch angle, a large flight distance is obtained. Use of a core having an outer-hard/inner-soft structure can achieve a low spin rate and a high launch angle.

Golf balls for which a hardness distribution of a core has been examined in light of achievement of various performance characteristics are disclosed in JP2012-223569 (US2012/0270680), JP2012-223570 (US2012/0270681), JP2012-223571 (US2012/0270679), and JP2012-223572 (US2012/0270678).

JP2012-223571 discloses a golf ball that includes a core having a three-layer structure. In the core, a first layer, a second layer, and a third layer are formed from the central point of the core toward the surface of the core. The hardness gradient of the third layer of the core is greater than the hardness gradient of the second layer. JP2012-223569, JP2012-223570, and JP2012-223572 also disclose similar golf balls. In the core of the golf ball disclosed in JP2012-223569, the hardness of the second layer at a boundary portion between the first layer and the second layer is less than the hardness of the first layer. In the core of the golf ball disclosed in JP2012-223570, the hardness of the third layer at a boundary portion between the second layer and the third layer is less than the hardness of the second layer. JP2012-223572 discloses a core in which the hardness of the second layer at a boundary portion between the first layer and the second layer is less than the hardness of the first layer and the hardness of the third layer at a boundary portion between the second layer and the third layer is less than the hardness of the second layer.

Skilled golf players also place importance on feel at impact when hitting a golf ball. Some golf players prefer particularly soft feel at impact upon an approach shot around the green.

In recent years, golf players' requirements for flight performance have been escalated more than ever. A golf ball with which a larger flight distance is achieved upon a shot with a driver and with which a golf player's preference can also be satisfied for feel at impact upon an approach shot, is desired. The inventors of the present invention have found that a hardness gradient in a specific region of a core contributes to an increase in a flight distance upon a shot with a driver without impairing various performance characteristics upon an approach shot, and have completed the present invention by optimizing the hardness distributions of the core and the entire ball.

An object of the present invention is to provide a golf ball that achieves both excellent flight performance upon a shot with a driver and favorable feel at impact upon an approach shot, in particular, upon an approach shot around the green.

SUMMARY OF THE INVENTION

A golf ball according to the present invention includes a spherical core, a mid layer positioned outside the core, and a cover positioned outside the mid layer. The core includes an inner core, a mid core positioned outside the inner core, and an outer core positioned outside the mid core. The mid layer includes an inner mid layer and an outer mid layer positioned outside the inner mid layer. A JIS-C hardness H(C) at a point C present outward from a boundary between the inner core and the mid core in a radius direction by 1 mm is equal to or greater than a JIS-C hardness H(B) at a point B present inward from the boundary between the inner core and the mid core in the radius direction by 1 mm. A JIS-C hardness H(E) at a point E present outward from a boundary between the mid core and the outer core in the radius direction by 1 mm is equal to or greater than a JIS-C hardness H(D) at a point D present inward from the boundary between the mid core and the outer core in the radius direction by 1 mm. When an angle (degree) calculated by (Formula 1) from a thickness Y (mm) of the mid core, the hardness H(C), and the hardness H(D) is defined as an angle α and an angle (degree) calculated by (Formula 2) from a thickness Z (mm) of the outer core, the hardness H(E), and a JIS-C hardness H(F) at a point F located on a surface of the core is defined as an angle β:

$$\alpha=(180°/\pi)*a\tan[\{H(D)-H(C)\}/Y] \quad \text{(Formula 1); and}$$

$$\beta=(180°/\pi)*a\tan[\{H(F)-H(E)\}/Z] \quad \text{(Formula 2),}$$

the angle α is equal to or greater than 0°, and a difference (α−β) between the angle α and the angle β is equal to or greater than 0°. A Shore D hardness Hm2 of the outer mid layer is less than a Shore D hardness Hm1 of the inner mid layer. A Shore D hardness Hc of the cover is less than the hardness Hm2.

In the golf ball according to the present invention, a hardness distribution of the core is appropriate. The golf ball has excellent resilience performance. When the golf ball is hit with a driver, the ball speed is high. When the golf ball is hit with a driver, the spin rate is low. The high ball speed and the low spin rate achieve a large flight distance. The golf ball has excellent flight performance.

In the golf ball according to the present invention, a hardness distribution of the entire ball is appropriate. When the golf ball is hit with a short iron, the feel at impact is soft. The golf ball satisfies a preference of a golf player who prefers soft feel at impact, in particular, upon an approach shot around the green.

Preferably, the angle β is equal to or greater than −20° but equal to or less than +20°.

Preferably, a ratio (Y/X) of the thickness Y of the mid core relative to a radius X of the inner core is equal to or greater than 0.5 but equal to or less than 2.0. Preferably, a ratio (Z/X) of the thickness Z of the outer core relative to the radius X is equal to or greater than 0.5 but equal to or less than 2.5.

Preferably, a ratio (S2/S1) of a cross-sectional area S2 of the mid core relative to a cross-sectional area S1 of the inner core on a cut surface of the core that has been cut into two halves is equal to or greater than 1.0 but equal to or less than 8.0. Preferably, a ratio (S3/S1) of a cross-sectional area S3 of the outer core relative to the cross-sectional area S1 on the cut surface of the core is equal to or greater than 2.5 but equal to or less than 12.5.

Preferably, a ratio (V2/V1) of a volume V2 of the mid core relative to a volume V1 of the inner core is equal to or greater than 2.5 but equal to or less than 20.0. Preferably, a ratio (V3/V1) of a volume V3 of the outer core relative to the volume V1 is equal to or greater than 10.0 but equal to or less than 57.0.

Preferably, a difference (Hm1−Hm2) between the hardness Hm1 and the hardness Hm2 is equal to or greater than 10.

Preferably, a sum (Tm1+Tm2) of a thickness Tm1 of the inner mid layer and a thickness Tm2 of the outer mid layer is equal to or greater than 0.8 mm but equal to or less than 2.2 mm. Preferably, the thickness Tm2 is smaller than the thickness Tm1. Preferably, a thickness Tc of the cover is smaller than the thickness Tm2.

Preferably, the hardness Hm1 is equal to or greater than 55 but equal to or less than 80. Preferably, the hardness Hm2 is equal to or greater than 30 but equal to or less than 65.

DESCRIPTION OF THE PREFERRED EMBODIMENTS

The following will describe in detail the present invention, based on preferred embodiments with reference to the accompanying drawing.

Figure 1:
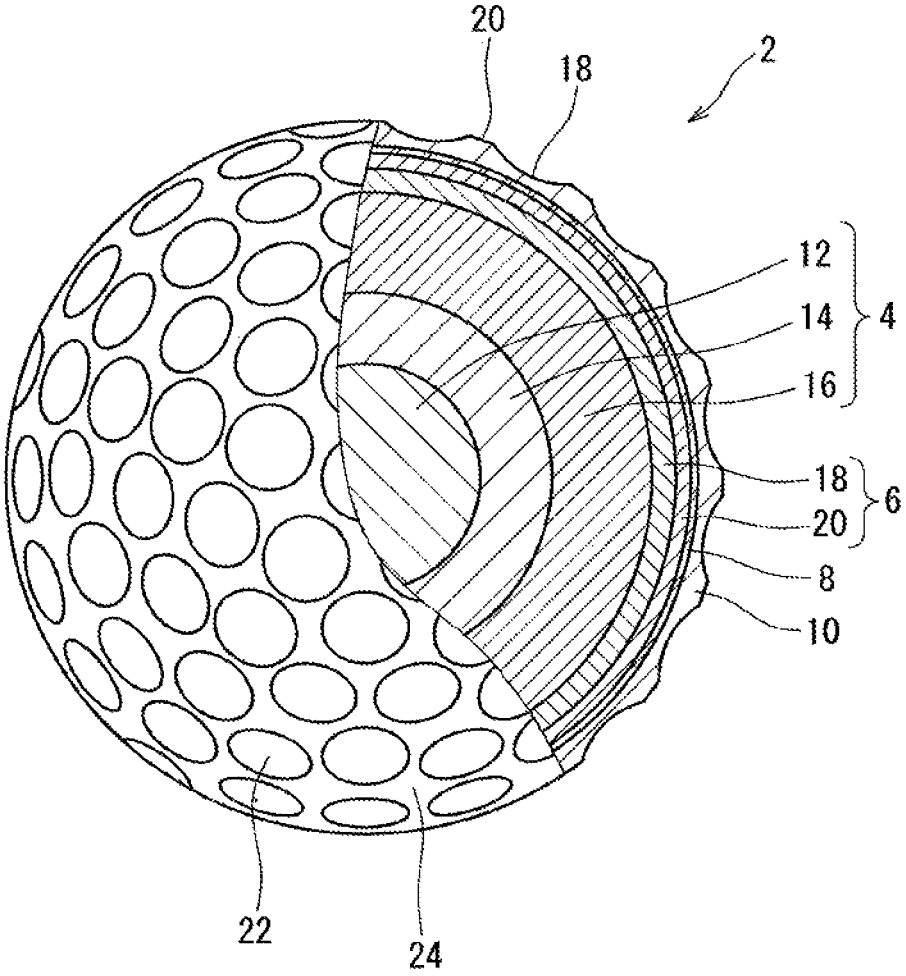
FIG. 1 is a cross-sectional view of a golf ball according to one embodiment of the present invention.

FIG. 1 is a partially cutaway cross-sectional view of a golf ball 2 according one embodiment of the present invention. The golf ball 2 includes a spherical core 4, a mid layer 6 positioned outside the core 4, a reinforcing layer 8 positioned outside the mid layer 6, and a cover 10 positioned outside the reinforcing layer 8. The core 4 includes an inner core 12, a mid core 14 positioned outside the inner core 12, and an outer core 16 positioned outside the mid core 14. The mid layer 6 includes an inner mid layer 18 and an outer mid layer 20 positioned outside the inner mid layer 18. On the surface of the cover 10, a large number of dimples 22 are formed. Of the surface of the cover 10, a part other than the dimples 22 is a land 24. The golf ball 2 includes a paint layer and a mark layer on the external side of the cover 10, but these layers are not shown in the drawing.

The golf ball 2 has a diameter of 40 mm or greater but 45 mm or less. From the standpoint of conformity to the rules established by the United States Golf Association (USGA), the diameter is preferably equal to or greater than 42.67 nm. In light of suppression of air resistance, the diameter is preferably equal to or less than 44 mm and more preferably equal to or less than 42.80 mm. The golf ball 2 has a weight of 40 g or greater but 50 g or less. In light of attainment of great inertia, the weight is preferably equal to or greater than 44 g and more preferably equal to or greater than 45.00 g. From the standpoint of conformity to the rules established by the USGA, the weight is preferably equal to or less than 45.93 g.

In the present invention, a JIS-C hardness H(A) at the central point A of the core 4, a JIS-C hardness H(B) at a point B inward from the boundary between the inner core 12 and the mid core 14 in a radius direction by 1 mm, a JIS-C hardness H(C) at a point C outward from the boundary between the inner core 12 and the mid core 14 in the radius direction by 1 mm, a JIS-C hardness H(D) at a point D inward from the boundary between the mid core 14 and the outer core 16 in the radius direction by 1 mm, a JIS-C hardness H(E) at a point E outward from the boundary between the mid core 14 and the outer core 16 in the radius direction by 1 mm, and a JIS-C hardness H(F) at a point F located on the surface of the core 4 are measured. The hardnesses H(A) to H(E) are measured by pressing a JIS-C type hardness scale against a cut plane of the core 4 that has been cut into two halves. The hardness H(F) is measured by pressing the JIS-C type hardness scale against the surface of the spherical core 4. For the measurement, an automated rubber hardness measurement machine (trade name "P1", manufactured by Kobunshi Keiki Co., Ltd.), to which this hardness scale is mounted, is used.

Figure 2:
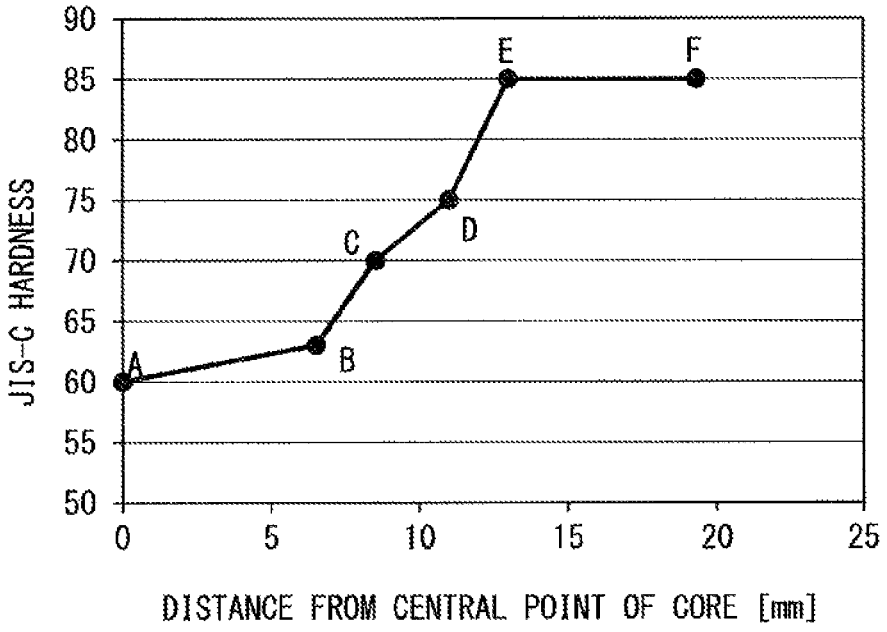
FIG. 2 is a graph showing a hardness distribution of a core of the golf ball in FIG. 1.

FIG. 2 is a line graph showing a hardness distribution of the core 4 of the golf ball 2 in FIG. 1. The horizontal axis of the graph indicates the distance (mm) from the central point of the core 4 to each measuring point. The vertical axis of the graph indicates a JIS-C hardness at each measuring point. The distances and the hardnesses measured at the points A to F are plotted on the graph.

As shown in FIG. 2, the hardness H(C) is greater than the hardness H(B). In the core 4, at a boundary portion between the inner core 12 and the mid core 14, the hardness of the mid core 14 is greater than the hardness of the inner core 12. As further shown, the hardness H(E) is greater than the hardness H(D). In the core 4, at a boundary portion between the mid core 14 and the outer core 16, the hardness of the outer core 16 is greater than the hardness of the mid core 14. In other words, in the core 4, the hardness increases stepwise from its inner side toward its outer side in the radius direction. When the golf ball 2 that includes the core 4 is hit with a driver, the spin rate is low. The low spin rate achieves a large flight distance. The hardness H(B) and the hardness H(C) may be the same, and the hardness H(D) and the hardness H(E) may be the same.

In light of suppression of spin, the difference [H(C)−H(B)] between the hardness H(C) and the hardness H(B) is preferably equal to or greater than 3 and more preferably equal to or greater than 5. In light of durability, the difference [H(C)−H(B)] is preferably equal to or less than 20.

In light of suppression of spin, the difference [H(E)−H(D)] between the hardness H(E) and the hardness H(D) is preferably equal to or greater than 5 and more preferably equal to or greater than 8. In light of durability, the difference [H(E)−H(D)] is preferably equal to or less than 25.

In the present invention, an angle α is calculated by the following (Formula 1):

$$\alpha=(180°/\pi)*a\tan[\{H(D)-H(C)\}/Y] \quad \text{(Formula 1)},$$

wherein Y is the thickness (mm) of the mid core 14.

In the present invention, an angle β is calculated by the following (Formula 2):

$$\beta=(180°/\pi)*a\tan[\{H(F)-H(E)\}/Z] \quad \text{(Formula 2)},$$

wherein Z is the thickness (mm) of the outer core 16.

The angle β is smaller than the angle α. This means that a hardness gradient formed in the outer core 16 is less than a hardness gradient formed in the mid core 14. The core 4 has excellent resilience performance. When the golf ball 2 that includes the core 4 is hit with a driver, the ball speed is high. The high ball speed achieves a large flight distance. The angle α and the angle β may be the same.

Preferably, the difference (α−β) between the angle α and the angle β is equal to or greater than 0°. In light of flight performance, the difference (α−β) is preferably equal to or greater than 10°, more preferably equal to or greater than 15°, and particularly preferably equal to or greater than 20°. In light of durability, the difference ($\alpha-\beta$) is preferably equal to or less than 60°. Preferably, the absolute value of the angle $\alpha$ is greater than the absolute value of the angle $\beta$.

In light of suppression of spin, the angle $\alpha$ is preferably equal to or greater than 0°. The angle $\alpha$ is more preferably equal to or greater than 20° and further preferably equal to or greater than 30°. In light of durability, the angle $\alpha$ is preferably equal to or less than 60°.

From the standpoint that a ball speed is high upon hitting, the angle $\beta$ is preferably equal to or greater than −20° but equal to or less than +20°. The angle $\beta$ is more preferably equal to or greater than −15° but equal to or less than +15°, and further preferably equal to or greater than −10° but equal to or less than +10°.

The inner core 12 is formed by crosslinking a rubber composition. Examples of the base rubber of the rubber composition include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

Preferably, the rubber composition of the inner core 12 includes a co-crosslinking agent. The co-crosslinking agent achieves high resilience performance of the inner core 12. Examples of preferable co-crosslinking agents in light of resilience performance include monovalent or bivalent metal salts of an $\alpha,\beta$-unsaturated carboxylic acid having 2 to 8 carbon atoms. A metal salt of an $\alpha,\beta$-unsaturated carboxylic acid graft-polymerizes with the molecular chain of the base rubber, thereby crosslinking the rubber molecules. Examples of preferable metal salts of an $\alpha,\beta$-unsaturated carboxylic acid include zinc acrylate, magnesium acrylate, zinc methacrylate, and magnesium methacrylate. Zinc acrylate and zinc methacrylate are more preferred.

As a co-crosslinking agent, an $\alpha,\beta$-unsaturated carboxylic acid having 2 to 8 carbon atoms and a metal compound may also be included. The metal compound reacts with the $\alpha,\beta$-unsaturated carboxylic acid in the rubber composition. A salt obtained by this reaction graft-polymerizes with the molecular chain of the base rubber. Examples of preferable $\alpha,\beta$-unsaturated carboxylic acids include acrylic acid and methacrylic acid.

Examples of preferable metal compounds include metal hydroxides such as magnesium hydroxide, zinc hydroxide, calcium hydroxide, and sodium hydroxide; metal oxides such as magnesium oxide, calcium oxide, zinc oxide, and copper oxide; and metal carbonates such as magnesium carbonate, zinc carbonate, calcium carbonate, sodium carbonate, lithium carbonate, and potassium carbonate. Metal oxides are preferred. Oxides including a bivalent metal are more preferred. An oxide including a bivalent metal reacts with the co-crosslinking agent to form metal crosslinks. Examples of particularly preferable metal oxides include zinc oxide and magnesium oxide.

In light of resilience performance, the amount of the co-crosslinking agent per 100 parts by weight of the base rubber is preferably equal to or greater than 20 parts by weight and more preferably equal to or greater than 25 parts by weight. In light of soft feel at impact, the amount of the co-crosslinking agent per 100 parts by weight of the base rubber is preferably equal to or less than 50 parts by weight and more preferably equal to or less than 45 parts by weight.

The rubber composition of the inner core 12 may include an organic peroxide together with the co-crosslinking agent. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. In light of versatility, dicumyl peroxide is preferred.

In light of resilience performance, the amount of the organic peroxide per 100 parts by weight of the base rubber is preferably equal to or greater than 0.1 parts by weight, more preferably equal to or greater than 0.3 parts by weight, and particularly preferably equal to or greater than 0.5 parts by weight. In light of soft feel at impact, the amount of the organic peroxide per 100 parts by weight of the base rubber is preferably equal to or less than 2.0 parts by weight, more preferably equal to or less than 1.5 parts by weight, and particularly preferably equal to or less than 1.2 parts by weight.

Preferably, the rubber composition of the inner core 12 includes an organic sulfur compound. Examples of preferable organic sulfur compounds include monosubstitutions such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, and the like; disubstitutions such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, and the like; trisubstitutions such as bis(2,4,6-trichlorophenyl)disulfide, bis(2-cyano-4-chloro-6-bromophenyl)disulfide, and the like; tetrasubstitutions such as bis(2,3,5,6-tetrachlorophenyl)disulfide and the like; and pentasubstitutions such as bis(2,3,4,5,6-pentachlorophenyl)disulfide, bis(2,3,4,5,6-pentabromophenyl)disulfide, and the like. Other examples of preferable organic sulfur compounds include thionaphthols such as 2-thionaphthol, 1-thionaphthol, 2-chloro-1-thionaphthol, 2-bromo-1-thionaphthol, 2-fluoro-1-thionaphthol, 2-cyano-1-thionaphthol, 2-acetyl-1-thionaphthol, 1-chloro-2-thionaphthol, 1-bromo-2-thionaphthol, 1-fluoro-2-thionaphthol, 1-cyano-2-thionaphthol, 1-acetyl-2-thionaphthol, and the like; and metal salts thereof. The organic sulfur compound contributes to resilience performance. More preferable organic sulfur compounds are diphenyl disulfide, bis(pentabromophenyl)disulfide, and 2-thionaphthol.

In light of resilience performance, the amount of the organic sulfur compound per 100 parts by weight of the base rubber is preferably equal to or greater than 0.1 parts by weight and more preferably equal to or greater than 0.2 parts by weight. In light of resilience performance, the amount is preferably equal to or less than 3.0 parts by weight and more preferably equal to or less than 2.0 parts by weight.

The rubber composition of the inner core 12 may include a fatty acid or a fatty acid metal salt. It is thought that the fatty acid or the fatty acid metal salt contributes to formation of the hardness distribution of the core 4 by inhibiting formation of metal crosslinks by the co-crosslinking agent or cutting the metal crosslinks during heating and forming of the inner core 12. When a fatty acid or a fatty acid metal salt is added, a preferable amount thereof is equal to or greater than 0.5 parts by weight but equal to or less than 20 parts by weight, per 100 parts by weight of the base rubber.

A fatty acid metal salt is preferred from the standpoint that an appropriate hardness distribution is obtained. Examples of the fatty acid metal salt include potassium salts, magnesium salts, aluminum salts, zinc salts, iron salts, copper salts, nickel salts, and cobalt salts of octanoic acid, lauric acid, myristic acid, palmitic acid, stearic acid, oleic acid, and behenic acid. Zinc salts of fatty acids are particularly preferred. Specific examples of preferable zinc salts of fatty acids include zinc octoate, zinc laurate, zinc myristate, and zinc stearate.

For the purpose of adjusting specific gravity and the like, a filler may be included in the inner core 12. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. A particularly preferable filler is zinc oxide. Zinc oxide serves not only as a specific gravity adjuster but also as a crosslinking activator. The amount of the filler is determined as appropriate so that the intended specific gravity of the inner core 12 is accomplished.

According to need, various additives such as sulfur, an anti-aging agent, a coloring agent, a plasticizer, a dispersant, and the like are included in the inner core 12 in an adequate amount. Crosslinked rubber powder or synthetic resin powder may also be included in the inner core 12. The temperature for crosslinking the inner core 12 is generally equal to or higher than 140° C. but equal to or lower than 180° C. The time period for crosslinking the inner core 12 is generally equal to or longer than 10 minutes but equal to or shorter than 60 minutes.

The central hardness of the inner core 12 is the same as the aforementioned JIS-C hardness H(A) at the central point A of the core 4. The hardness H(A) is preferably equal to or greater than 30 but equal to or less than 75. The inner core 12 having a hardness H(A) of 30 or greater can achieve excellent resilience performance. In this respect, the hardness H(A) is more preferably equal to or greater than 35 and particularly preferably equal to or greater than 40. The inner core 12 having a hardness H(A) of 75 or less suppresses excessive spin upon a shot with a driver. In this respect, the hardness H(A) is more preferably equal to or less than 73 and particularly preferably equal to or less than 70.

The JIS-C hardness H(B) at the point B inward from the boundary between the inner core 12 and the mid core 14 in the radius direction by 1 mm is preferably equal to or greater than 35 but equal to or less than 80. The inner core 12 having a hardness H(B) of 35 or greater suppresses excessive spin upon a shot with a driver. In this respect, the hardness H(B) is more preferably equal to or greater than 40 and particularly preferably equal to or greater than 45. The inner core 12 having a hardness H(B) of 80 or less achieves excellent durability. In this respect, the hardness H(B) is more preferably equal to or less than 75 and particularly preferably equal to or less than 70.

Preferably, the hardness H(B) is greater than the hardness H(A). The inner core 12 contributes to formation of an outer-hard/inner-soft structure. In light of suppression of spin upon a shot with a driver, the difference [H(B)−H(A)] between the hardness H(B) and the hardness H(A) is preferably equal to or greater than 1 and more preferably equal to or greater than 3. In light of resilience performance, the difference [H(B)−H(A)] is preferably equal to or less than 10.

The radius X of the inner core 12 can be set as appropriate such that later-described conditions are met. In light of resilience performance, the radius X is preferably equal to or greater than 2.0 mm and more preferably equal to or greater than 5.0 mm. The radius X is preferably equal to or less than 12.0 mm.

A cross-sectional area S1 of the inner core 12 is measured on a cut plane of the spherical core 4 that has been cut into two halves. The cross-sectional area S1 can be set as appropriate such that later-described conditions are met. In light of resilience performance, the cross-sectional area S1 is preferably equal to or greater than 12 $mm^2$ and more preferably equal to or greater than 78 mm. The cross-sectional area S1 is preferably equal to or less than 450 $mm^2$.

The volume V1 of the inner core 12 can be set as appropriate such that later-described conditions are met. In light of resilience performance, the volume V1 is preferably equal to or greater than 33 $mm^3$ and more preferably equal to or greater than 520 $mm^3$. The volume V1 is preferably equal to or less than 7200 $mm^3$.

In light of feel at impact, the inner core 12 has an amount of compressive deformation of preferably 1.0 mm or greater, more preferably 1.2 mm or greater, and particularly preferably 1.3 mm or greater. In light of resilience performance, the amount of compressive deformation is preferably equal to or less than 4.0 mm, more preferably equal to or less than 3.5 mm, and particularly preferably equal to or less than 3.0 mm.

For measurement of the amount of compressive deformation, a YAMADA type compression tester is used. In the tester, the inner core 12 that is an object to be measured is placed on a hard plate made of metal. Next, a cylinder made of metal gradually descends toward the inner core 12. The inner core 12, squeezed between the bottom face of the cylinder and the hard plate, becomes deformed. A migration distance of the cylinder, starting from the state in which an initial load of 98 N is applied to the inner core 12 up to the state in which a final load of 294 N is applied thereto, is measured. A moving speed of the cylinder until the initial load is applied is 0.83 mm/s. A moving speed of the cylinder after the initial speed is applied until the final load is applied is 1.67 mm/s.

The mid core 14 is formed by crosslinking a rubber composition. As the base rubber of the rubber composition of the mid core 14, the base rubber described above for the inner core 12 can be used. In light of resilience performance, polybutadienes are preferred, and high-cis polybutadienes are particularly preferred.

The rubber composition of the mid core 14 can include the co-crosslinking agent described above for the inner core 12. Preferable co-crosslinking agents in light of resilience performance are acrylic acid, methacrylic acid, zinc acrylate, magnesium acrylate, zinc methacrylate, and magnesium methacrylate. The rubber composition further includes the metal compound described above for the inner core 12. Examples of preferable metal compounds include magnesium oxide and zinc oxide.

The rubber composition of the mid core 14 can include the organic peroxide described above for the inner core 12. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

Preferably, the rubber composition of the mid core 14 can include the organic sulfur compound described above for the inner core 12. Preferable organic sulfur compounds are diphenyl disulfide, bis(pentabromophenyl)disulfide, and 2-thionaphthol. The rubber composition of the mid core 14 may include the fatty acid or the fatty acid metal salt described above for the inner core 12.

According to need, various additives such as a filler, sulfur, a vulcanization accelerator, an anti-aging agent, a coloring agent, a plasticizer, a dispersant, and the like are included in the rubber composition of the mid core 14 in an adequate amount. The temperature for crosslinking the mid core 14 is generally equal to or higher than 140° C. but equal to or lower than 180° C. The time period for crosslinking the mid core 14 is generally equal to or longer than 10 minutes but equal to or shorter than 60 minutes.

The JIS-C hardness H(C) at the point C outward from the boundary between the inner core 12 and the mid core 14 in the radius direction by 1 mm is preferably equal to or greater than 60 but equal to or less than 90. The mid core 14 having a hardness H(C) of 60 or greater can achieve excellent resilience performance. In this respect, the hardness H(C) is more preferably equal to or greater than 63 and particularly preferably equal to or greater than 65. The mid core 14 having a hardness H(C) of 90 or less suppresses excessive spin upon a shot with a driver. In this respect, the hardness H(C) is more preferably equal to or less than 85 and particularly preferably equal to or less than 80.

The JIS-C hardness H(D) at the point D inward from the boundary between the mid core 14 and the outer core 16 in the radius direction by 1 mm is preferably equal to or greater than 65 but equal to or less than 95. The mid core 14 having a hardness H(D) of 65 or greater suppresses excessive spin upon a shot with a driver. In this respect, the hardness H(D) is more preferably equal to or greater than 68 and particularly preferably equal to or greater than 70. The mid core 14 having a hardness H(D) of 95 or less achieves excellent durability. In this respect, the hardness H(D) is more preferably equal to or less than 90 and particularly preferably equal to or less than 85.

In light of suppression of spin upon a shot with a driver, the difference [H(D)−H(C)] between the hardness H(D) and the hardness H(C) is preferably equal to or greater than 0 and more preferably equal to or greater than 3. In light of durability, the difference [H(D)−H(C)] is preferably equal to or less than 15.

The thickness Y of the mid core 14 can be set as appropriate such that the later-described conditions are met. In light of resilience performance, the thickness Y is preferably equal to or greater than 1.0 mm and more preferably equal to or greater than 4.5 mm. The thickness Y is preferably equal to or less than 11.0 mm.

A cross-sectional area S2 of the mid core 14 is measured on a cut plane of the spherical core 4 that has been cut into two halves. The cross-sectional area S2 can be set as appropriate such that the later-described conditions are met. In light of resilience performance, the cross-sectional area S2 is preferably equal to or greater than 50 $mm^2$ and more preferably equal to or greater than 270 $mm^2$. The cross-sectional area S2 is preferably equal to or less than 680 $mm^2$.

The volume V2 of the mid core 14 can be set as appropriate such that the later-described conditions are met. In light of resilience performance, the volume V2 is preferably equal to or greater than 800 $mm^3$ and more preferably equal to or greater than 5400 $mm^3$. The volume V2 is preferably equal to or less than 17500 $mm^3$.

In light of feel at impact, a sphere consisting of the inner core 12 and the mid core 14 has an amount of compressive deformation of preferably 3.0 mm or greater, more preferably 3.5 mm or greater, and particularly preferably 4.0 mm or greater. In light of resilience performance, the amount of compressive deformation is preferably equal to or less than 7.0 mm, more preferably equal to or less than 6.8 mm, and particularly preferably equal to or less than 6.5 mm.

For measurement of the amount of compressive deformation, a YAMADA type compression tester is used. In the tester, the sphere consisting of the inner core 12 and the mid core 14 which sphere is an object to be measured is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load of 98 N is applied to the sphere up to the state in which a final load of 1274 N is applied thereto, is measured. A moving speed of the cylinder until the initial load is applied is 0.83 mm/s. A moving speed of the cylinder after the initial speed is applied until the final load is applied is 1.67 mm/s.

The outer core 16 is formed by crosslinking a rubber composition. As the base rubber of the rubber composition of the outer core 16, the base rubber described above for the inner core 12 can be used. In light of resilience performance, polybutadienes are preferred, and high-cis polybutadienes are particularly preferred.

The rubber composition of the outer core 16 can include the co-crosslinking agent described above for the inner core 12. Preferable co-crosslinking agents in light of resilience performance are acrylic acid, methacrylic acid, zinc acrylate, magnesium acrylate, zinc methacrylate, and magnesium methacrylate. The rubber composition further includes the metal compound described above for the inner core 12. Examples of preferable metal compounds include magnesium oxide and zinc oxide.

The rubber composition of the outer core 16 can include the organic peroxide described above for the inner core 12. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

Preferably, the rubber composition of the outer core 16 can include the organic sulfur compound described above for the inner core 12. Preferable organic sulfur compounds are diphenyl disulfide, bis(pentabromophenyl)disulfide, and 2-thionaphthol. The rubber composition of the outer core 16 may include the fatty acid or the fatty acid metal salt described above for the inner core 12.

According to need, various additives such as a filler, sulfur, a vulcanization accelerator, an anti-aging agent, a coloring agent, a plasticizer, a dispersant, and the like are included in the rubber composition of the outer core 16 in an adequate amount. The temperature for crosslinking the outer core 16 is generally equal to or higher than 140° C. but equal to or lower than 180° C. The time period for crosslinking the outer core 16 is generally equal to or longer than 10 minutes but equal to or shorter than 60 minutes.

The JIS-C hardness H(E) at the point E outward from the boundary between the mid core 14 and the outer core 16 in the radius direction by 1 mm is preferably equal to or greater than 75 but equal to or less than 100. The outer core 16 having a hardness H(E) of 75 or greater can achieve excellent resilience performance. In this respect, the hardness H(E) is more preferably equal to or greater than 78 and particularly preferably equal to or greater than 80. The outer core 16 having a hardness H(E) of 100 or less suppresses excessive spin upon a shot with a driver. In this respect, the hardness H(E) is more preferably equal to or less than 95 and particularly preferably equal to or less than 93.

The JIS-C hardness H(F) at the point F located on the surface of the core 4 consisting of the inner core 12, the mid core 14, and the outer core 16 is preferably equal to or greater than 75 but equal to or less than 100. The outer core 16 having a hardness H(F) of 75 or greater suppresses excessive spin upon a shot with a driver. In this respect, the hardness H(F) is more preferably equal to or greater than 78 and particularly preferably equal to or greater than 80. The outer core 16 having a hardness H(F) of 100 or less achieves excellent durability. In this respect, the hardness H(F) is more preferably equal to or less than 95 and particularly preferably equal to or less than 93. The hardness H(F) is measured by pressing a JIS-C type hardness scale against the surface of the core 4. For the measurement, an automated rubber hardness measurement machine (trade name "P1", manufactured by Kobunshi Keiki Co., Ltd.), to which this hardness scale is mounted, is used.

In light of suppression of spin upon a shot with a driver, the difference [H(F)−H(E)] between the hardness H(F) and the hardness H(E) is preferably equal to or greater than −5 and more preferably equal to or greater than −2. In light of durability, the difference [H(F)−H(E)] is preferably equal to or less than 5.

In light of suppression of spin upon a shot with a driver, the difference [H(F)−H(A)] between the hardness H(F) and the hardness H(A) is preferably equal to or greater than 20 and more preferably equal to or greater than 24. In light of durability, the difference [H(F)−H(A)] is preferably equal to or less than 40.

The thickness Z of the outer core 16 can be set as appropriate such that the later-described conditions are met. In light of resilience performance, the thickness Z is preferably equal to or greater than 3.0 mm and more preferably equal to or greater than 5.0 mm. The thickness Z is preferably equal to or less than 12.0 mm.

A cross-sectional area S3 of the outer core 16 is measured on a cut plane of the spherical core 4 that has been cut into two halves. The cross-sectional area S3 can be set as appropriate such that the later-described conditions are met. In light of resilience performance, the cross-sectional area S3 is preferably equal to or greater than 380 $mm^2$ and more preferably equal to or greater than 590 $mm^2$. The cross-sectional area S3 is preferably equal to or less than 1020 mm.

The volume V3 of the outer core 16 can be set as appropriate such that the later-described conditions are met. In light of resilience performance, the volume V3 is preferably equal to or greater than 13500 $mm^3$ and more preferably equal to or greater than 18700 $mm^3$. The volume V3 is preferably equal to or less than 30200 $mm^3$.

In light of the resilience performance, the core 4 has a diameter of preferably 36.5 mm or greater, more preferably 37.0 mm or greater, and particularly preferably 37.3 mm or greater. The diameter is preferably equal to or less than 42.0 mm, more preferably equal to or less than 41.0 mm, and particularly preferably equal to or less than 40.2 mm. The core 4 has a weight of preferably 25 g or greater but 42 g or less.

In light of feel at impact, the core 4 has an amount of compressive deformation Dc of preferably 2.0 mm or greater and particularly preferably 2.5 mm or greater. In light of resilience performance of the core 4, the amount of compressive deformation Dc is preferably equal to or less than 4.8 mm and particularly preferably equal to or less than 4.5 mm. The amount of compressive deformation Dc of the core 4 is measured by the same measurement method as that for the amount of compressive deformation of the sphere consisting of the inner core 12 and the mid core 14.

With the golf ball 2 according to the present invention, excellent flight performance is achieved upon a shot with a driver by relatively controlling the hardness gradient of the mid core 14 and the hardness gradient of the outer core 16. An appropriate arrangement of the inner core 12, the mid core 14, and the outer core 16 contributes to optimization of a hardness distribution.

In light of suppression of spin upon a shot with a driver, the ratio (Y/X) of the thickness Y of the mid core 14 relative to the radius X of the inner core 12 is preferably equal to or greater than 0.5, more preferably equal to or greater than 0.6, and particularly preferably equal to or greater than 0.8. From the standpoint that a high ball speed is obtained, the ratio (Y/X) is preferably equal to or less than 2.0, more preferably equal to or less than 1.7, and particularly preferably equal to or less than 1.4.

In light of suppression of spin upon a shot with a driver, the ratio (Z/X) of the thickness Z of the outer core 16 relative to the radius X of the inner core 12 is preferably equal to or greater than 0.5, more preferably equal to or greater than 0.7, and particularly preferably equal to or greater than 0.9. From the standpoint that a high ball speed is obtained, the ratio (Z/X) is preferably equal to or less than 2.5 and more preferably equal to or less than 2.0.

In light of flight performance, the ratio (Y/Z) of the thickness Y of the mid core 14 relative to the thickness Z of the outer core 16 is equal to or greater than 0.25 but equal to or less than 3.0.

In light of suppression of spin upon a shot with a driver, the ratio (S2/S1) of the cross-sectional area S2 of the mid core 14 relative to the cross-sectional area S1 of the inner core 12 is preferably equal to or greater than 1.0, more preferably equal to or greater than 1.5, and particularly preferably equal to or greater than 2.0. From the standpoint that a high ball speed is obtained, the ratio (S2/S1) is preferably equal to or less than 8.0, more preferably equal to or less than 6.5, and particularly preferably equal to or less than 6.0.

In light of suppression of spin upon a shot with a driver, the ratio (S3/S1) of the cross-sectional area S3 of the outer core 16 relative to the cross-sectional area S1 of the inner core 12 is preferably equal to or greater than 2.5 and more preferably equal to or greater than 3.0. From the standpoint that a high ball speed is obtained, the ratio (S3/S1) is preferably equal to or less than 12.5, more preferably equal to or less than 12.0, and particularly preferably equal to or less than 11.5.

In light of flight performance, the ratio (S2/S3) of the cross-sectional area S2 of the mid core 14 relative to the cross-sectional area S3 of the outer core 16 is equal to or greater than 0.08 but equal to or less than 1.80.

In light of suppression of spin upon a shot with a driver, the ratio (V2/V1) of the volume V2 of the mid core 14 relative to the volume V1 of the inner core 12 is preferably equal to or greater than 2.5, more preferably equal to or greater than 3.0, and particularly preferably equal to or greater than 4.5. From the standpoint that a high ball speed is obtained, the ratio (V2/V1) is preferably equal to or less than 20.0, more preferably equal to or less than 19.0, and particularly preferably equal to or less than 18.5.

In light of suppression of spin upon a shot with a driver, the ratio (V3/V1) of the volume V3 of the outer core 16 relative to the volume V1 of the inner core 12 is preferably equal to or greater than 10.0, more preferably equal to or greater than 10.5, and particularly preferably equal to or greater than 11.0. From the standpoint that a high ball speed is obtained, the ratio (V3/V1) is preferably equal to or less than 57.0, more preferably equal to or less than 51.0, and particularly preferably equal to or less than 45.0.

In light of flight performance, the ratio (V2/V3) of the volume V2 of the mid core 14 relative to the volume V3 of the outer core 16 is equal to or greater than 0.04 but equal to or less than 1.25.

In the present invention, a resin composition is suitably used for the inner mid layer 18. Examples of the base polymer of the resin composition include ionomer resins, polystyrenes, polyesters, polyamides, and polyolefins. A particularly preferable base polymer is an ionomer resin. The golf ball 2 that includes the inner mid layer 18 including the ionomer resin has excellent flight performance and feel at impact.

Examples of preferable ionomer resins include metal ion-neutralized products of binary copolymers formed with an α-olefin and an α,β-unsaturated carboxylic acid having 3 to 8 carbon atoms. A preferable binary copolymer includes 80% by weight or more but 90% by weight or less of an α-olefin, and 10% by weight or more but 20% by weight or less of an α,β-unsaturated carboxylic acid. The binary copolymer has excellent resilience performance. Examples of other preferable ionomer resins include metal ion-neutralized products of ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable copolymer is a copolymer formed with ethylene and acrylic acid or methacrylic acid.

In the ionomer resin, some or all of the carboxyl groups included in the binary copolymer and the ternary copolymer are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7318", "Himilan AM7329", "Himilan AM7337", "Himilan MK7320", and "Himilan MK7329", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation.

For the inner mid layer 18, two or more ionomer resins may be used in combination. An ionomer resin neutralized with a monovalent metal ion, and an ionomer resin neutralized with a bivalent metal ion may be used in combination.

For the inner mid layer 18, an ionomer resin and another resin may be used in combination. In this case, the principal component of the base polymer is preferably the ionomer resin. Specifically, the proportion of the ionomer resin to the entire base polymer is preferably equal to or greater than 50% by weight, more preferably equal to or greater than 60% by weight, and particularly preferably equal to or greater than 70% by weight.

As described later, the inner mid layer 18 has a hardness Hm1 greater than a hardness Hm2 of the outer mid layer 20. By blending a highly elastic resin in the resin composition of the inner mid layer 18, a great hardness Hm1 may be achieved. Specific examples of the highly elastic resin include polyamide resins.

For the purpose of adjusting specific gravity and the like, a filler may be included in the resin composition of the inner mid layer 18. Examples of suitable fillers include zinc oxide, barium sulfate, calcium carbonate, and magnesium carbonate. Powder of a metal with a high specific gravity may be included as a filler. Specific examples of metals with a high specific gravity include tungsten and molybdenum. The amount of the filler is determined as appropriate so that the intended specific gravity of the inner mid layer 18 is accomplished. According to need, a coloring agent such as titanium dioxide, a dispersant, an antioxidant, an ultraviolet absorber, a light stabilizer, a fluorescent material, a fluorescent brightener, and the like are included in the inner mid layer 18.

From the standpoint that favorable feel at impact is obtained, the hardness Hm1 of the inner mid layer 18 is preferably equal to or less than 80, more preferably equal to or less than 76, and particularly preferably equal to or less than 73. From the standpoint that the resilience performance of the core 4 is not impaired, the hardness Hm1 is preferably equal to or greater than 55, more preferably equal to or greater than 58, and particularly preferably equal to or greater than 60. From the standpoint that an outer-hard/inner-soft structure is formed in a sphere consisting of the core 4 and the inner mid layer 18, the hardness of the inner mid layer 18 may be set so as to be greater than the surface hardness of the core 4.

The hardness Hm1 is measured according to the standards of "ASTM-D 2240-68" with a Shore D type hardness scale mounted to an automated rubber hardness measurement machine (trade name "P1", manufactured by Kobunshi Keiki Co., Ltd.). For the measurement, a slab that is formed by hot press and that has a thickness of about 2 mm is used. A slab kept at 23° C. for two weeks is used for the measurement. At the measurement, three slabs are stacked. A slab formed from the same resin composition as the resin composition of the inner mid layer 18 is used.

In light of feel at impact and durability, the inner mid layer 18 has a thickness Tm1 of preferably 0.4 mm or greater, more preferably 0.7 mm or greater, and particularly preferably 0.8 mm or greater. From the standpoint that a large core 4 can be included, the thickness Tm1 of the inner mid layer 18 is preferably equal to or less than 1.1 mm.

For forming the inner mid layer 18, known methods such as injection molding, compression molding, and the like can be used.

For the outer mid layer 20, a resin composition is suitably used. Examples of the base polymer of the resin composition include ionomer resins, polystyrenes, polyesters, polyamides, and polyolefins.

A particularly preferable base polymer is an ionomer resin. The golf ball 2 that includes the outer mid layer 20 including the ionomer resin has excellent resilience performance. The ionomer resin described above for the inner mid layer 18 can also be used for the outer mid layer 20.

An ionomer resin and another resin may be used in combination. In this case, in light of resilience performance, the ionomer resin is included as the principal component of the base polymer. The proportion of the ionomer resin to the entire base polymer is preferably equal to or greater than 50% by weight, more preferably equal to or greater than 60% by weight, and particularly preferably equal to or greater than 70% by weight.

A preferable resin that can be used in combination with an ionomer resin is a styrene block-containing thermoplastic elastomer. The styrene block-containing thermoplastic elastomer has excellent compatibility with ionomer resins. A resin composition including the styrene block-containing thermoplastic elastomer has excellent fluidity.

The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 48% by weight, and particularly preferably equal to or less than 46% by weight.

In the present invention, styrene block-containing thermoplastic elastomers include an alloy of an olefin and one or more members selected from the group consisting of SBS, SIS, SIBS, and hydrogenated products thereof. The olefin component in the alloy is presumed to contribute to improvement of compatibility with ionomer resins. Use of this alloy improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

Examples of another resin that can be used in combination with an ionomer resin include binary copolymers formed with an α-olefin and an α,β-unsaturated carboxylic acid having 3 to 8 carbon atoms, and ternary copolymers formed with: an α-olefin; an α,β-unsaturated carboxylic acid having 3 to 8 carbon atoms; and an α,β-unsaturated carboxylate ester having 2 to 22 carbon atoms. Binary copolymers are more preferred. A preferable binary copolymer is an ethylene-(meth) acrylic acid copolymer. This copolymer is obtained by a copolymerization reaction of a monomer composition that contains ethylene and (meth)acrylic acid. This copolymer includes 3% by weight or greater but 25% by weight or less of a (meth)acrylic acid component. An ethylene-methacrylic acid copolymer having a polar functional group is preferred.

Specific examples of the ethylene-methacrylic acid copolymer include trade names "NUCREL N1050H", "NUCREL N1110H", and "NUCREL N1035", manufactured by Du Pont-MITSUI POLYCHEMICALS Co., Ltd., and the like.

According to need, a filler such as zinc oxide, a coloring agent such as titanium dioxide, a dispersant, an antioxidant, an ultraviolet absorber, a light stabilizer, a fluorescent material, a fluorescent brightener, and the like are included in the resin composition of the outer mid layer 20 in an adequate amount.

In light of flight performance, the outer mid layer 20 has a Shore D hardness Hm2 of preferably 30 or greater, more preferably 35 or greater, and particularly preferably 40 or greater. In light of feel at impact of the golf ball 2, the hardness Hm2 is preferably equal to or less than 65, more preferably equal to or less than 60, and particularly preferably equal to or less than 55. The hardness Hm2 is measured by the same method as that for the hardness Hm1.

The hardness Hm2 of the outer mid layer 20 is less than the hardness Hm1 of the inner mid layer 18. When the golf ball 2 is hit with a short iron whose head speed is low, the outer mid layer 20 contributes to feel at impact. The small hardness Hm2 of the outer mid layer 20 provides soft feel at impact to a golf player. The golf ball 2 can satisfy a preference of a golf player who particularly prefers soft feel at impact.

A hardness distribution of the mid layer 6 that includes the outer mid layer 20 and the inner mid layer 18 also contributes to the controllability of the golf ball 2. When the golf ball 2 in which the hardness Hm2 is less than the hardness Hm1 is hit with a short iron, the spin rate is high. The golf ball 2 has excellent controllability upon an approach shot.

In light of feel at impact, controllability, and flight performance, the difference (Hm1−Hm2) between the hardness Hm1 and the hardness Hm2 is preferably equal to or greater than 8 and more preferably equal to or greater than 10. In light of durability, the difference (Hm1−Hm2) is preferably equal to or less than 30.

In light of feel at impact and durability, the outer mid layer 20 has a thickness Tm2 of preferably 0.4 mm or greater and more preferably 0.5 mm or greater. From the standpoint that a large core 4 can be included, the thickness Tm2 of the outer mid layer 20 is preferably equal to or less than 1.1 mm, more preferably equal to or less than 1.0 mm, and particularly preferably equal to or less than 0.9 mm.

In the golf ball 2, the inner mid layer 18 and the outer mid layer 20 greatly contribute to feel at impact upon an approach shot. In this respect, the sum (Tm1+Tm2) of the thickness Tm1 of the inner mid layer 18 and the thickness Tm2 of the outer mid layer 20 is preferably equal to or greater than 0.8 mm, more preferably equal to or greater than 1.0 mm, and particularly preferably equal to or greater than 1.5 mm. From the standpoint that the resilience performance of the core 4 is sufficiently exerted, the sum (Tm1+Tm2) is preferably equal to or less than 2.2 mm, more preferably equal to or less than 2.1 mm, and particularly preferably equal to or less than 2.0 mm.

Preferably, the thickness Tm2 of the outer mid layer 20 is smaller than the thickness Tm1 of the inner mid layer 18. In the golf ball 2, the resilience performance of the core 4 upon a shot with a driver is not greatly impaired. In light of achievement of both desired flight performance and soft feel at impact, the difference (Tm1−Tm2) between the thickness Tm1 and the thickness Tm2 is preferably equal to or greater than 0.1 mm and more preferably equal to or greater than 0.2 mm. The difference (Tm1−Tm2) is preferably equal to or less than 0.8 mm.

For forming the outer mid layer 20, known methods such as injection molding, compression molding, and the like can be used.

In light of feel at impact, a sphere consisting of the core 4 and the mid layer 6 has an amount of compressive deformation of preferably 1.7 mm or greater, more preferably 1.8 mm or greater, and particularly preferably 1.9 mm or greater. In light of resilience performance, the amount of compressive deformation of the sphere is preferably equal to or less than 4.0 mm, more preferably equal to or less than 3.6 mm, and particularly preferably equal to or less than 3.4 mm. The amount of compressive deformation of the sphere consisting of the core 4 and the mid layer 6 is measured by the same measurement method as that for the amount of compressive deformation of the sphere consisting of the inner core 12 and the mid core 14. Preferably, the sphere consisting of the core 4 and the mid layer 6 has a diameter of 39.1 mm or greater but 42.3 mm or less.

In the present invention, a resin composition is suitably used for the cover 10. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. A preferable base polymer is a thermoplastic polyurethane elastomer. The thermoplastic polyurethane elastomer is flexible. The thermoplastic polyurethane elastomer contributes to the feel at impact of the cover 10. The cover 10 formed from the resin composition is also excellent in controllability and scuff resistance.

The thermoplastic polyurethane elastomer includes a polyurethane component as a hard segment, and a polyester component or a polyether component as a soft segment. Examples of isocyanates for the polyurethane component include alicyclic diisocyanates, aromatic diisocyanates, and aliphatic diisocyanates. Two or more diisocyanates may be used in combination.

Examples of alicyclic diisocyanates include 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI). In light of versatility and processability, $H_{12}$MDI is preferred.

Examples of aromatic diisocyanates include 4,4'-diphenylmethane diisocyanate (MDI) and toluene diisocyanate (TDI). Examples of aliphatic diisocyanates include hexamethylene diisocyanate (HDI).

Alicyclic diisocyanates are particularly preferred. Since an alicyclic diisocyanate does not have any double bond in the main chain, the alicyclic diisocyanate suppresses yellowing of the cover 10. In addition, since an alicyclic diisocyanate has excellent strength, the alicyclic diisocyanate suppresses damage of the cover 10.

Specific examples of thermoplastic polyurethane elastomers include trade names "Elastollan NY80A", "Elastollan NY82A", "Elastollan NY84A", "Elastollan NY84A10 Clear", "Elastollan NY85A", "Elastollan NY88A", "Elastollan NY90A", "Elastollan NY97A", "Elastollan NY585", "Elastollan XKP016N", "Elastollan 1195ATR", "Elastollan ET890A", and "Elastollan ET88050", manufactured by BASF Japan Ltd.; and trade names "RESAMINE P4585LS" and "RESAMINE PS62490", manufactured by Dainichiseika Color & Chemicals Mfg. Co., Ltd.

A thermoplastic polyurethane elastomer and another resin may be used in combination. Examples of the resin that can be used in combination include thermoplastic polyester elastomers, thermoplastic polyamide elastomers, thermoplastic polyolefin elastomers, styrene block-containing thermoplastic elastomers, and ionomer resins. When a thermoplastic polyurethane elastomer and another resin are used in combination, the thermoplastic polyurethane elastomer is included as the principal component of the base polymer, in light of spin performance and scuff resistance. The proportion of the thermoplastic polyurethane elastomer to the entire base polymer is preferably equal to or greater than 50% by weight, more preferably equal to or greater than 70% by weight, and particularly preferably equal to or greater than 85% by weight.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 10 in an adequate amount.

In light of achievement of both desired flight performance and desired feel at impact, the cover 10 has a Shore D hardness Hc of preferably 10 or greater and more preferably 15 or greater. In light of controllability and feel at impact, the hardness Hc is preferably equal to or less than 55 and more preferably equal to or less than 50. The hardness Hc is measured by the same measurement method as that for the hardness Hm1.

The hardness Hc of the cover 10 is less than the hardness Hm2 of the outer mid layer 20. The hardness Hm2 is less than the hardness Hm1. In the golf ball 2, the hardness does not sharply decrease from the inner mid layer 18 to the cover 10. When the golf ball 2 is hit with a driver whose head speed is high, the resilience performance and the spin performance by the core 4 are not impaired and are sufficiently exerted. With the golf ball 2, a large flight distance is achieved upon a shot with a driver. When the golf ball 2 is hit with a short iron whose head speed is low, the shock by the hit is alleviated by the inner mid layer 18, the outer mid layer 20, and the cover 10 in which the hardness gradually decreases. In the golf ball 2, excellent and soft feel at impact is provided, in particular, upon an approach shot. In the golf ball 2, both excellent flight performance upon a shot with a driver and favorable feel at impact upon an approach shot are achieved.

In light of achievement of both desired flight performance and desired feel at impact, the difference (Hm2−Hc) between the hardness Hm2 and the hardness Hc is preferably equal to or greater than 10 and more preferably equal to or greater than 15. In light of durability, the difference (Hm2−Hc) is preferably equal to or less than 50.

In light of achievement of both desired flight performance and desired feel at impact, the difference (Hm1−Hc) between the hardness Hm1 and the hardness Hc is preferably equal to or greater than 25 and more preferably equal to or greater than 30. In light of durability, the difference (Hm1−Hc) is preferably equal to or less than 60.

In light of feel at impact and durability, the cover 10 has a thickness Tc of preferably 0.1 mm or greater and more preferably 0.2 mm or greater. In light of flight performance, the thickness Tc is preferably equal to or less than 1.2 mm and more preferably equal to or less than 0.8 mm.

Preferably, the thickness Tc of the cover 10 is smaller than the thickness Tm2 of the outer mid layer 20. In the golf ball 2, although the cover 10 is flexible, flight performance is not greatly impaired. In light of achievement of both desired flight performance and desired feel at impact, the difference (Tm2−Tc) between the thickness Tm2 and the thickness Tc is preferably equal to or greater than 0.1 mm and more preferably equal to or greater than 0.2 mm. The difference (Tm2−Tc) is preferably equal to or less than 0.8 mm.

Preferably, the thickness Tc of the cover 10 is smaller than the thickness Tm1 of the inner mid layer 18. In light of achievement of both desired flight performance and desired feel at impact, the difference (Tm1−Tc) between the thickness Tm1 and the thickness Tc is preferably equal to or greater than 0.5 mm and more preferably equal to or greater than 0.6 mm. The difference (Tm1−Tc) is preferably equal to or less than 1.5 mm.

The cover 10 may be composed of two layers, namely, an inner cover and an outer cover positioned outside the inner cover. By the cover 10 being made into a two-layer structure, the hardness distribution of the entire ball can be further precisely controlled. When the cover 10 is made into a two-layer structure, the sum of the thicknesses of the two layers of the cover is preferably equal to or greater than 0.1 mm but equal to or less than 1.2 mm.

For forming the cover 10, known methods such as injection molding, compression molding, and the like can be used. When forming the cover 10, the dimples 22 are formed by pimples formed on the cavity face of a mold.

In light of feel at impact, the golf ball 2 has an amount of compressive deformation Db of preferably 1.6 mm or greater, more preferably 1.7 mm or greater, and particularly preferably 1.8 mm or greater. In light of resilience performance, the amount of compressive deformation Db is preferably equal to or less than 3.5 mm, more preferably equal to or less than 3.4 mm, and particularly preferably equal to or less than 3.3 mm. The amount of compressive deformation Db of the golf ball 2 is measured by the same measurement method as that for the amount of compressive deformation of the sphere consisting of the inner core 12 and the mid core 14.

In light of durability, the golf ball 2 that further includes the reinforcing layer 8 between the mid layer 6 and the cover 10 is preferred. The reinforcing layer 8 is positioned between the mid layer 6 and the cover 10. The reinforcing layer 8 firmly adheres to the mid layer 6 and also to the cover 10. The reinforcing layer 8 suppresses separation of the cover 10 from the mid layer 6. When the golf ball 2 is hit with the edge of a clubface, a wrinkle is likely to occur. The reinforcing layer 8 suppresses occurrence of a wrinkle to improve the durability of the golf ball 2.

As the base polymer of the reinforcing layer 8, a two-component curing type thermosetting resin is suitably used. Specific examples of two-component curing type thermosetting resins include epoxy resins, urethane resins, acrylic resins, polyester resins, and cellulose resins. In light of strength and durability of the reinforcing layer 8, two-component curing type epoxy resins and two-component curing type urethane resins are preferred.

A two-component curing type epoxy resin is obtained by curing an epoxy resin with a polyamide type curing agent. Examples of epoxy resins used in two-component curing type epoxy resins include bisphenol A type epoxy resins, bisphenol F type epoxy resins, and bisphenol AD type epoxy resins. In light of balance among flexibility, chemical resistance, heat resistance, and toughness, bisphenol A type epoxy resins are preferred. Specific examples of the polyamide type curing agent include polyamide amine curing agents and modified products thereof. In a mixture of an epoxy resin and a polyamide type curing agent, the ratio of the epoxy equivalent of the epoxy resin to the amine active hydrogen equivalent of the polyamide type curing agent is preferably equal to or greater than 1.0/1.4 but equal to or less than 1.0/1.0.

A two-component curing type urethane resin is obtained by a reaction of abase material and a curing agent. A two-component curing type urethane resin obtained by a reaction of a base material containing a polyol component and a curing agent containing a polyisocyanate or a derivative thereof, and a two-component curing type urethane resin obtained by a reaction of a base material containing an isocyanate group-terminated urethane prepolymer and a curing agent having active hydrogen, can be used. Particularly, a two-component curing type urethane resin obtained by a reaction of a base material containing a polyol component and a curing agent containing a polyisocyanate or a derivative thereof, is preferred.

The reinforcing layer 8 may include additives such as a coloring agent (typically, titanium dioxide), a phosphate-based stabilizer, an antioxidant, a light stabilizer, a fluorescent brightener, an ultraviolet absorber, an anti-blocking agent, and the like. The additives may be added to the base material of the two-component curing type thermosetting resin, or may be added to the curing agent of the two-component curing type thermosetting resin.

The reinforcing layer 8 is obtained by applying, to the surface of the mid layer 6, a liquid that is prepared by dissolving or dispersing the base material and the curing agent in a solvent. In light of workability, application with a spray gun is preferred. After the application, the solvent is volatilized to permit a reaction of the base material with the curing agent, thereby forming the reinforcing layer 8. Examples of preferable solvents include toluene, isopropyl alcohol, xylene, methyl ethyl ketone, methyl isobutyl ketone, ethylene glycol monomethyl ether, ethylbenzene, propylene glycol monomethyl ether, isobutyl alcohol, and ethyl acetate.

In light of suppression of a wrinkle, the reinforcing layer 8 has a thickness of preferably 3 μm or greater and more preferably 5 μm or greater. In light of ease of forming the reinforcing layer 8, the thickness is preferably equal to or less than 100 μm, more preferably equal to or less than 50 μm, and further preferably equal to or less than 20 μm. The thickness is measured by observing a cross section of the golf ball 2 with a microscope. When the mid layer 6 has concavities and convexities on its surface from surface roughening, the thickness is measured at a convex part.

In light of suppression of a wrinkle, the reinforcing layer 8 has a pencil hardness of preferably 4 B or greater and more preferably B or greater. In light of reduced loss of the power transmission from the cover 10 to the mid layer 6 upon hitting the golf ball 2, the pencil hardness of the reinforcing layer 8 is preferably equal to or less than 3 H. The pencil hardness is measured according to the standards of "JIS K5600".

When the mid layer 6 and the cover 10 sufficiently adhere to each other so that a wrinkle is unlikely to occur, the reinforcing layer 8 may not be provided.

EXAMPLES

The following will show the effects of the present invention by means of Examples, but the present invention should not be construed in a limited manner based on the description of these Examples.

Example 1

A rubber composition was obtained by kneading 100 parts by weight of a high-cis polybutadiene (trade name "BR-730", manufactured by JSR Corporation), 34.8 parts by weight of magnesium oxide (trade name "MAGSARAT 150ST", manufactured by Sankyo Kasei Co., Ltd.), 28.0 parts by weight of methacrylic acid (manufactured by MITSUBISHI RAYON CO., LTD.), and 0.9 parts by weight of dicumyl peroxide (trade name "Percumyl D", manufactured by NOF Corporation). This rubber composition was placed into a mold including upper and lower mold halves each having a hemispherical cavity, and heated at 170° C. for 25 minutes to obtain a spherical inner core with a diameter of 15.0 mm.

A rubber composition was obtained by kneading 100 parts by weight of a high-cis polybutadiene (the aforementioned "BR-730"), 25.0 parts by weight of zinc diacrylate (trade name "Sanceler SR", manufactured by SANSHIN CHEMICAL INDUSTRY CO., LTD.), 5 parts by weight of zinc oxide, an appropriate amount of barium sulfate (manufactured by Sakai Chemical Industry Co., Ltd.), 0.7 parts by weight of dicumyl peroxide (the aforementioned "Percumyl D"), and 0.5 parts by weight of diphenyl disulfide (manufactured by Sumitomo Seika Chemicals Co., Ltd.). Half shells were formed from this rubber composition. The inner core was covered with two of these half shells. The inner core and the half shells were placed into a mold including upper and lower mold halves each having a hemispherical cavity, and heated at 170° C. for 25 minutes. A mid core was formed from the rubber composition. The diameter of the obtained sphere consisting of the inner core and the mid core was 24.0 mm. The amount of barium sulfate was adjusted such that the specific gravity of the mid core coincides with the specific gravity of the inner core.

A rubber composition was obtained by kneading 100 parts by weight of a high-cis polybutadiene (the aforementioned "BR-730"), 40.0 parts by weight of zinc diacrylate (the aforementioned "Sanceler SR"), 5 parts by weight of zinc oxide, an appropriate amount of barium sulfate (manufactured by Sakai Chemical Industry Co., Ltd.), 0.7 parts by weight of dicumyl peroxide (the aforementioned "Percumyl D"), 0.5 parts by weight of diphenyl disulfide (manufactured by Sumitomo Seika Chemicals Co., Ltd.), and 0.1 parts by weight of an anti-aging agent (trade name "H-BHT", manufactured by HONSHU CHEMICAL INDUSTRY CO., LTD.). Half shells were formed from this rubber composition. The sphere consisting of the inner core and the mid core was covered with two of these half shells. The sphere consisting of the inner core and the mid core and the half shells were placed into a mold including upper and lower mold halves each having a hemispherical cavity, and heated at 170° C. for 25 minutes to obtain a core with a diameter of 38.5 mm. An outer core was formed from the rubber composition. The amount of barium sulfate was adjusted such that the specific gravity of the outer core coincides with the specific gravity of each of the inner core and the mid core and the weight of a golf ball is 45.4 g.

A resin composition was obtained by kneading 50.0 parts by weight of an ionomer resin (the aforementioned "Surlyn 8150"), and 50.0 parts by weight of another ionomer resin (the aforementioned "Surlyn 9150"), 4.0 parts by weight of titanium dioxide (manufactured by Ishihara Sangyo Kaisha, Ltd.), and an appropriate amount of barium sulfate (manufactured by Sakai Chemical Industry Co., Ltd.) with a twin-screw kneading extruder. The extruding conditions were a screw diameter of 45 mm, a screw rotational speed of 200 rpm, screw L/D of 35, and a die temperature of 160° C. to 230° C. The core was placed into a mold. The resin composition was injected around the core by injection molding to form an inner mid layer with a thickness of 1.0 mm.

A resin composition was obtained by kneading 34.5 parts by weight of an ionomer resin (the aforementioned "Himilan AM7329"), 27.5 parts by weight of another ionomer resin (the aforementioned "Himilan AM7337"), 16.0 parts by weight of an ethylene-methacrylic acid copolymer (the aforementioned "NUCREL N1050H"), 22.0 parts by weight of a polymer alloy (the aforementioned "Rabalon T3221C"), 4.0 parts by weight of titanium dioxide (manufactured by Ishihara Sangyo Kaisha, Ltd.), and an appropriate amount of barium sulfate (manufactured by Sakai Chemical Industry Co., Ltd.) with a twin-screw kneading extruder. The extruding conditions were a screw diameter of 45 mm, a screw rotational speed of 200 rpm, screw L/D of 35, and a die temperature of 160° C. to 230° C. The sphere consisting of the core and the inner mid layer was placed into a mold. The resin composition was injected around the sphere by injection molding to form an outer mid layer with a thickness of 0.8 nm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the outer mid layer with an air gun, and kept at 23° C. for 12 hours to obtain a reinforcing layer with a thickness of 10 μm.

A resin composition was obtained by kneading 100 parts by weight of a thermoplastic polyurethane elastomer (trade name "Elastollan NY84A10 Clear", manufactured by BASF Japan Ltd.), 1.7 parts by weight of a mold release agent (trade name "Elastollan Wax Master VD", manufactured by BASF Japan Ltd.), 4.0 parts by weight of titanium dioxide (manufactured by Sakai Chemical Industry Co., Ltd.), and 0.2 parts by weight of a light stabilizer (trade name "JF-90", manufactured by Johoku Chemical Co., Ltd.) with a twin-screw kneading extruder under the above extruding conditions. Half shells were formed from this resin composition by compression molding. The sphere consisting of the core, the mid layer, and the reinforcing layer was covered with two of these half shells. The sphere and the half shells were placed into a final mold that includes upper and lower mold halves each having a hemispherical cavity and that has a large number of pimples on its cavity face. A cover was obtained by compression molding. The thickness of the cover was 0.3 mm. Dimples having a shape that is the inverted shape of the pimples were formed on the cover. The surface of the cover was polished. A clear paint including a two-component curing type polyurethane as a base material was applied to this cover with an air gun, and was dried and cured to obtain a golf ball of Example 1 with a diameter of 42.7 mm and a weight of 45.6 g.

Examples 2 to 22 and Comparative Examples 1 to 12

Golf balls of Examples 2 to 22 and Comparative Examples 1 to 12 were obtained in the same manner as Example 1, except the specifications of the core, the mid layer, and the cover were as shown in Tables 12 to 18 below. The rubber composition of the core is shown in detail in Tables 1 to 3 below. The specifications and the hardness distribution of the core are shown in Tables 6 to 11 below. The resin compositions of the mid layer and the cover are shown in detail in Tables 4 and 5 below.

[Hit with Driver (W#1)]

A driver with a titanium head (trade name "XXIO", manufactured by DUNLOP SPORTS CO. LTD., shaft hardness: S, loft angle: 10.0°) was attached to a swing machine manufactured by True Temper Co. A golf ball was hit under the condition of a head speed of 45 (m/s). The ball speed (m/s)

and the spin rate (rpm) immediately after the hit were measured. Furthermore, the flight distance (m) from the launch point to the stop point was measured. The average value of data obtained by 10 measurements is shown in Tables 12 to 18 below.

[Hit with Sand Wedge (SW)]

A sand wedge was attached to a swing machine manufactured by True Temper Co. A golf ball was hit under the condition of a head speed of 21 m/sec. The backspin rate (rpm) was measured immediately after the hit. The average value of data obtained by 10 measurements is shown in Tables 12 to 18 below.

[Feel at Impact with Sand Wedge (SW)]

Ten golf players hit golf balls with sand wedges and were asked about feel at impact based on the following criteria. In the criteria, a score for feel at impact that is recognized as the most preferable by a golf player is 6. The average of the scores of the ten players is shown in Tables 12 to 18 below.

Score 7: too soft
6: favorably soft
5: slightly soft
4: normal
3: slightly hard
2: hard
1: too hard

TABLE 1

Formulation of Core (parts by weight)

| Type | 1 | 2 | 3 | 4 | 5 | 6 |
|---|---|---|---|---|---|---|
| BR-730 | 100 | 100 | 100 | 100 | 100 | 100 |
| MAGSARAT 150ST | 34.8 | — | — | — | — | — |
| Methacrylic acid | 28.0 | — | — | — | — | — |
| Sanceler SR | — | 25.0 | 25.0 | 38.0 | 38.0 | 46.5 |
| Zinc oxide | — | 5 | 5 | 5 | 5 | 5 |
| Barium sulfate | — | * | * | * | * | * |
| Dicumyl peroxide | 0.9 | 0.7 | 0.7 | 0.7 | 0.9 | 0.7 |
| PBDS | — | — | — | — | 0.3 | — |
| DPDS | — | 0.3 | 0.5 | 0.5 | — | 0.5 |
| H-BHT | — | — | — | — | — | 0.1 |

* Appropriate amount

TABLE 2

Formulation of Core (parts by weight)

| Type | 7 | 8 | 9 | 10 | 11 | 12 | 13 |
|---|---|---|---|---|---|---|---|
| BR-730 | 100 | 100 | 100 | 100 | 100 | 100 | 100 |
| MAGSARAT 150ST | — | — | — | — | — | — | — |
| Methacrylic acid | — | — | — | — | — | — | — |
| Sanceler SR | 40.0 | 46.5 | 32.5 | 35.0 | 30.0 | 40.0 | 25.0 |
| Zinc oxide | 5 | 5 | 5 | 5 | 5 | 5 | 5 |
| Barium sulfate | * | * | * | * | * | * | * |
| Dicumyl peroxide | 0.7 | 0.7 | 0.9 | 0.9 | 0.7 | 0.7 | 0.7 |
| PBDS | — | — | 0.3 | 0.3 | — | — | — |
| DPDS | 0.5 | 0.5 | — | — | 0.5 | 0.5 | 0.5 |
| H-BHT | 0.1 | 0.1 | — | — | 0.1 | 0.1 | 0.05 |

* Appropriate amount

The details of the compounds listed in Tables 1 and 2 are as follows.

BR-730: a high-cis polybutadiene manufactured by JSR Corporation (cis-1,4-bond content: 96% by weight, 1,2-vinyl bond content: 1.3% by weight, Mooney viscosity ($ML_{1+4}$ (100° C.)): 55, molecular weight distribution (Mw/Mn): 3)

MAGSARAT 150ST: magnesium oxide manufactured by Sankyo Kasei Co., Ltd.

Sanceler SR: zinc diacrylate manufactured by SANSHIN CHEMICAL INDUSTRY CO., LTD. (a product coated with 10% by weight of stearic acid)

Zinc oxide: trade name "Ginrei R", manufactured by Toho Zinc Co., Ltd.

Barium sulfate: trade name "Barium Sulfate BD", manufactured by Sakai Chemical Industry Co., Ltd.

Dicumyl peroxide: trade name "Percumyl D", manufactured by NOF Corporation

PBDS: bis(pentabromophenyl)disulfide manufactured by Kawaguchi Chemical Industry Co., Ltd.

DPDS: diphenyl disulfide manufactured by Sumitomo Seika Chemicals Co., Ltd.

H-BHT: dibutyl hydroxy toluene (anti-aging agent) manufactured by HONSHU CHEMICAL INDUSTRY CO., LTD.

TABLE 3

Formulation of Core (parts by weight)

| | Type | | | |
|---|---|---|---|---|
| | B1 | B2 | B3 | B4 |
| Polybutadiene | 100 | 100 | 100 | — |
| Zinc diacrylate | 16.0 | 18.5 | 36.0 | — |
| Peroxide | 3 | 3 | 3 | — |
| Zinc oxide | 5 | 5 | 5 | — |
| Barium sulfate | 20.7 | 19.6 | 43.0 | — |
| Anti-aging agent | 0.1 | 0.1 | 0.1 | — |
| Pentachlorothiophenol zinc salt | 0.4 | 0.4 | 0.4 | — |
| Himilan 1605 | — | — | — | 50 |
| Himilan 1706 | — | — | — | 35 |
| Himilan 1557 | — | — | — | 15 |
| Trimethylol propane | — | — | — | 1.1 |

* Appropriate amount

The details of the compounds listed in Table 3 are as follows.

Zinc diacrylate: a product of Nihon Jyoryu Kogyo Co., Ltd.

Anti-aging agent: trade name "Nocrac NS-6", manufactured by Ouchi Shinko Chemical Industrial Co., Ltd.

Pentachlorothiophenol zinc salt: a product of Wako Chemical, Ltd.

Trimethylol propane: a product of Mitsubishi Gas Chemical Company, Inc.

TABLE 4

Formulations of Mid Layer and Cover (parts by weight)

| Type | a | b | c | d |
|---|---|---|---|---|
| Himilan 1605 | 50.0 | — | — | — |
| Himilan 7329 | 50.0 | — | 34.5 | 17.0 |
| Himilan 7337 | — | — | 27.5 | 17.5 |
| NUCREL N1050H | — | — | 16.0 | 20.0 |
| Rabalon T3221C | — | — | 22.0 | 45.5 |
| Surlyn 8150 | — | 50.0 | — | — |
| Surlyn 9150 | — | 50.0 | — | — |
| Titanium dioxide | 4.0 | 4.0 | 4.0 | 4.0 |

TABLE 4-continued

| Formulations of Mid Layer and Cover | | | | (parts by weight) |
|---|---|---|---|---|
| Type | a | b | c | d |
| Barium sulfate | * | * | * | * |
| Hardness (Shore D) | 65 | 70 | 50 | 32 |

* Appropriate amount

TABLE 5

| Formulations of Mid Layer and Cover | | | | (parts by weight) |
|---|---|---|---|---|
| Type | e | f | A | B |
| Himilan 1605 | — | — | — | — |
| Himilan 7329 | 42.5 | — | — | — |
| Himilan 7337 | 34.5 | — | — | — |
| NUCREL N1050H | 18.0 | — | — | — |
| Rabalon T3221C | 5.0 | — | — | — |
| Elastollan NY84A10 Clear | — | — | 100 | — |
| Elastollan NY88A10 Clear | — | — | — | 100 |
| CM1017K | — | 100 | — | — |
| Elastollan Wax Master VD | — | — | 1.7 | 1.7 |
| Titanium dioxide | 2.2 | 4.0 | 4.0 | 4.0 |
| Barium sulfate | * | * | — | — |
| JF-90 | — | — | 0.2 | 0.2 |
| Hardness (Shore D) | 60 | 80 | 31 | 36 |

* Appropriate amount

The details of the compounds listed in Tables 4 and 5 are as follows.

NUCREL N1050H: an ethylene-methacrylic acid copolymer manufactured by Du Pont-MITSUI POLYCHEMICALS Co., Ltd.

Rabalon T3221C: a thermoplastic polystyrene elastomer manufactured by Mitsubishi Chemical Corporation Titanium dioxide: a product of Ishihara Sangyo Kaisha, Ltd.

Barium sulfate: trade name "Barium Sulfate BD", manufactured by Sakai Chemical Industry Co., Ltd.

JF-90: bis(2,2,6,6-tetramethyl-4-piperidyl)sebacate (light stabilizer) manufactured by Johoku Chemical Co., Ltd.

CM1017K: polyamide 6 manufactured by Toray Industries, Inc.

TABLE 6

| Configuration of Core | | | | | |
|---|---|---|---|---|---|
| | C1 | C2 | C3 | C4 | C5 |
| Inner core Form. | 1 | 1 | 1 | 1 | 1 |
| Radius X (mm) | 7.5 | 7.5 | 7.5 | 7.5 | 7.5 |
| Area S1 ($mm^2$) | 177 | 177 | 177 | 177 | 177 |
| Volume V1 ($mm^3$) | 1767 | 1767 | 1767 | 1767 | 1767 |
| Mid core Form. | 3 | 3 | 3 | 3 | 3 |
| Thickness Y (mm) | 4.50 | 4.50 | 4.50 | 4.50 | 4.50 |
| Radius (mm) | 12.0 | 12.0 | 12.0 | 12.0 | 12.0 |
| Area S2 ($mm^2$) | 276 | 276 | 276 | 276 | 276 |
| Volume V2 ($mm^3$) | 5471 | 5471 | 5471 | 5471 | 5471 |

TABLE 6-continued

| Configuration of Core | | | | | |
|---|---|---|---|---|---|
| | C1 | C2 | C3 | C4 | C5 |
| Outer core Form. | 7 | 7 | 7 | 8 | 8 |
| Thickness Z (mm) | 7.25 | 7.45 | 7.05 | 7.25 | 7.05 |
| Radius (mm) | 19.25 | 19.45 | 19.05 | 19.25 | 19.05 |
| Area S3 ($mm^2$) | 712 | 736 | 638 | 712 | 688 |
| Volume V3 ($mm^3$) | 22642 | 23583 | 21720 | 22642 | 21720 |
| H(A) (JIS-C) central point | 60 | 60 | 60 | 60 | 60 |
| H(B) (JIS-C) | 63 | 63 | 63 | 63 | 63 |
| H(C) (JIS-C) | 70 | 70 | 70 | 70 | 70 |
| H(D) (JIS-C) | 75 | 75 | 75 | 75 | 75 |
| H(E) (JIS-C) | 85 | 85 | 85 | 86 | 86 |
| H(F) (JIS-C) surface | 85 | 85 | 85 | 84 | 84 |
| H(B) − H(A) | 3 | 3 | 3 | 3 | 3 |
| H(C) − H(B) | 7 | 7 | 7 | 7 | 7 |
| H(D) − H(C) | 5 | 5 | 5 | 5 | 5 |
| H(E) − H(D) | 10 | 10 | 10 | 11 | 11 |
| H(F) − H(E) | 0 | 0 | 0 | −2 | −2 |
| H(F) − H(A) | 25 | 25 | 25 | 24 | 24 |

TABLE 7

| Configuration of Core | | | | | |
|---|---|---|---|---|---|
| | C6 | C7 | C8 | C9 | C10 |
| Inner core Form. | 1 | 1 | 1 | 1 | 1 |
| Radius X (mm) | 7.5 | 7.5 | 7.5 | 7.5 | 7.5 |
| Area S1 ($mm^2$) | 177 | 177 | 177 | 177 | 177 |
| Volume V1 ($mm^3$) | 1767 | 1767 | 1767 | 1767 | 1767 |
| Mid core Form. | 3 | 3 | 3 | 3 | 2 |
| Thickness Y (mm) | 4.50 | 4.50 | 4.50 | 4.50 | 4.50 |
| Radius (mm) | 12.0 | 12.0 | 12.0 | 12.0 | 12.0 |
| Area S2 ($mm^2$) | 276 | 276 | 276 | 276 | 276 |
| Volume V2 ($mm^3$) | 5471 | 5471 | 5471 | 5471 | 5471 |
| Outer core Form. | 4 | 4 | 7 | 6 | 5 |
| Thickness Z (mm) | 7.25 | 7.05 | 6.65 | 8.05 | 7.25 |
| Radius (mm) | 19.25 | 19.05 | 18.65 | 20.05 | 19.25 |
| Area S3 ($mm^2$) | 712 | 688 | 640 | 811 | 712 |
| Volume V3 ($mm^3$) | 22642 | 21720 | 19934 | 26524 | 22642 |
| H(A) (JIS-C) central point | 60 | 60 | 60 | 60 | 60 |
| H(B) (JIS-C) | 63 | 63 | 63 | 63 | 63 |
| H(C) (JIS-C) | 70 | 70 | 70 | 70 | 70 |
| H(D) (JIS-C) | 75 | 75 | 75 | 75 | 72 |
| H(E) (JIS-C) | 84 | 84 | 85 | 85 | 83 |
| H(F) (JIS-C) surface | 86 | 86 | 85 | 85 | 88 |
| H(B) − H(A) | 3 | 3 | 3 | 3 | 3 |
| H(C) − H(B) | 7 | 7 | 7 | 7 | 7 |
| H(D) − H(C) | 5 | 5 | 5 | 5 | 2 |
| H(E) − H(D) | 9 | 9 | 10 | 10 | 11 |
| H(F) − H(E) | 2 | 2 | 0 | 0 | 5 |
| H(F) − H(A) | 26 | 26 | 25 | 25 | 28 |

TABLE 8

| | Configuration of Core | | | | |
|---|---|---|---|---|---|
| | C11 | C12 | C13 | C14 | C15 |
| Inner core Form. | 1 | 9 | 1 | 1 | 1 |
| Radius X (mm) | 7.5 | — | 7.5 | 7.5 | 5.0 |
| Area S1 ($mm^2$) | 177 | — | — | 177 | 79 |
| Volume V1 ($mm^3$) | 1767 | — | — | 1767 | 524 |
| Mid core Form. | 2 | — | 10 | 3 | 3 |
| Thickness Y (mm) | 4.50 | — | — | 6.00 | 5.00 |
| Radius (mm) | 12.0 | — | — | 13.5 | 10.0 |
| Area S2 ($mm^2$) | 276 | — | — | 396 | 236 |
| Volume V2 ($mm^3$) | 5471 | — | — | 8539 | 3665 |
| Outer core | 5 | — | — | 7 | 7 |
| Thickness Z (mm) | 7.05 | — | — | 5.75 | 9.25 |
| Radius (mm) | 19.05 | 19.25 | 19.25 | 19.25 | 19.25 |
| Area S3 ($mm^2$) | 688 | — | — | 592 | 850 |
| Volume V3 ($mm^3$) | 21720 | — | — | 19574 | 25691 |
| H(A) (JIS-C) central point | 60 | 65 | 60 | 60 | 60 |
| H(B) (JIS-C) | 63 | — | 63 | 63 | 63 |
| H(C) (JIS-C) | 70 | — | 71 | 70 | 70 |
| H(D) (JIS-C) | 72 | — | — | 75 | 75 |
| H(E) (JIS-C) | 83 | — | — | 85 | 85 |
| H(F) (JIS-C) surface | 88 | 88 | 88 | 85 | 85 |
| H(B) − H(A) | 3 | — | — | 3 | 3 |
| H(C) − H(B) | 7 | — | — | 7 | 7 |
| H(D) − H(C) | 2 | — | — | 5 | 5 |
| H(E) − H(D) | 11 | — | — | 10 | 10 |
| H(F) − H(E) | 5 | — | — | 0 | 0 |
| H(F) − H(A) | 28 | 23 | 28 | 25 | 25 |

TABLE 9

| | Configuration of Core | | | | |
|---|---|---|---|---|---|
| | C16 | C17 | C18 | C19 | C20 |
| Inner core Form. | 1 | 1 | 1 | 1 | 1 |
| Radius X (mm) | 5.0 | 5.0 | 7.5 | 7.5 | 7.5 |
| Area S1 ($mm^2$) | 79 | 79 | 177 | 177 | 177 |
| Volume V1 ($mm^3$) | 524 | 524 | 1767 | 1767 | 1767 |
| Mid core Form. | 3 | 3 | 11 | 2 | 11 |
| Thickness Y (mm) | 7.00 | 8.50 | 4.50 | 4.50 | 4.50 |
| Radius (mm) | 12.0 | 13.5 | 12.0 | 12.0 | 12.0 |
| Area S2 ($mm^2$) | 374 | 494 | 276 | 276 | 276 |
| Volume V2 ($mm^3$) | 6715 | 9782 | 5471 | 5471 | 5471 |
| Outer core Form. | 7 | 7 | 7 | 7 | 8 |
| Thickness Z (mm) | 7.25 | 5.75 | 7.25 | 7.25 | 7.25 |
| Radius (mm) | 19.25 | 19.25 | 19.25 | 19.25 | 19.25 |
| Area S3 ($mm^2$) | 712 | 592 | 712 | 712 | 712 |
| Volume V3 ($mm^3$) | 22642 | 19574 | 22642 | 22642 | 22642 |

TABLE 9-continued

| | Configuration of Core | | | | |
|---|---|---|---|---|---|
| | C16 | C17 | C18 | C19 | C20 |
| H(A) (JIS-C) central point | 60 | 60 | 60 | 60 | 60 |
| H(B) (JIS-C) | 63 | 63 | 63 | 63 | 63 |
| H(C) (JIS-C) | 70 | 70 | 73 | 70 | 73 |
| H(D) (JIS-C) | 75 | 75 | 73 | 72 | 73 |
| H(E) (JIS-C) | 85 | 85 | 85 | 85 | 86 |
| H(F) (JIS-C) surface | 85 | 85 | 85 | 85 | 84 |
| H(B) − H(A) | 3 | 3 | 3 | 3 | 3 |
| H(C) − H(B) | 7 | 7 | 10 | 7 | 10 |
| H(D) − H(C) | 5 | 5 | 0 | 2 | 0 |
| H(E) − H(D) | 10 | 10 | 12 | 13 | 13 |
| H(F) − H(E) | 0 | 0 | 0 | 0 | −2 |
| H(F) − H(A) | 25 | 25 | 25 | 25 | 24 |

TABLE 10

| | Configuration of Core | | |
|---|---|---|---|
| | C21 | C22 | C23 |
| Inner core. Form. | B1 | B4 | 2 |
| Radius X (mm) | 5.0 | 5.0 | 7.5 |
| Area S1 ($mm^2$) | 79 | 79 | 177 |
| Volume V1 ($mm^3$) | 524 | 524 | 1767 |
| Mid core Form. | B2 | B2 | 3 |
| Thickness Y (mm) | 8.00 | 8.00 | 4.50 |
| Radius (mm) | 13.0 | 13.0 | 12.0 |
| Area S2 ($mm^2$) | 452 | 452 | 276 |
| Volume V2 ($mm^3$) | 8679 | 8679 | 5471 |
| Outer core Form. | B3 | B3 | 7 |
| Thickness Z (mm) | 6.05 | 6.05 | 7.25 |
| Radius (mm) | 19.05 | 19.05 | 19.25 |
| Area S3 ($mm^2$) | 609 | 609 | 712 |
| Volume V3 ($mm^3$) | 19756 | 19756 | 22642 |
| H(A) (JIS-C) central point | 47 | 49 | 70 |
| H(B) (JIS-C) | 52 | 49 | 72 |
| H(C) (JIS-C) | 55 | 55 | 70 |
| H(D) (JIS-C) | 62 | 62 | 75 |
| H(E) (JIS-C) | 77 | 77 | 85 |
| H(F) (JIS-C) surface | 88 | 88 | 85 |
| H(B) − H(A) | 5 | 0 | 2 |
| H(C) − H(B) | 3 | 6 | −2 |
| H(D) − H(C) | 7 | 7 | 5 |
| H(E) − H(D) | 15 | 15 | 10 |
| H(F) − H(E) | 11 | 11 | 0 |
| H(F) − H(A) | 41 | 39 | 15 |

TABLE 11

| | Configuration of Core | | |
|---|---|---|---|
| | C24 | C25 | C26 |
| Inner core. Form. | 1 | 1 | 1 |
| Radius X (mm) | 7.5 | 7.5 | 7.5 |
| Area S1 ($mm^2$) | 177 | 177 | 177 |
| Volume V1 ($mm^3$) | 1767 | 1767 | 1767 |
| Mid core Form. | 3 | 12 | 13 |
| Thickness Y (mm) | 4.50 | 4.50 | 4.50 |
| Radius (mm) | 12.0 | 12.0 | 12.0 |
| Area S2 ($mm^2$) | 276 | 276 | 276 |
| Volume V2 ($mm^3$) | 5471 | 5471 | 5471 |
| Outer core Form. | 11 | 8 | 7 |
| Thickness Z (mm) | 7.25 | 7.25 | 7.25 |
| Radius (mm) | 19.25 | 19.25 | 19.25 |
| Area S3 ($mm^2$) | 712 | 712 | 712 |
| Volume V3 ($mm^3$) | 22642 | 22642 | 22642 |

TABLE 11-continued

| Configuration of Core | C24 | C25 | C26 |
|---|---|---|---|
| H(A) (JIS-C) | 60 | 60 | 60 |
| central point | | | |
| H(B) (JIS-C) | 63 | 63 | 63 |
| H(C) (JIS-C) | 70 | 73 | 71.5 |
| H(D) (JIS-C) | 75 | 72 | 73 |
| H(E) (JIS-C) | 73 | 86 | 85 |
| H(F) (JIS-C) | 73 | 84 | 85 |
| surface | | | |
| H(B) − H(A) | 3 | 3 | 3 |
| H(C) − H(B) | 7 | 10 | 9 |
| H(D) − H(C) | 5 | −1 | 2 |
| H(E) − H(D) | −2 | 14 | 12 |
| H(F) − H(E) | 0 | −2 | 0 |
| H(F) − H(A) | 13 | 24 | 25 |

TABLE 12

| Configuration of Ball and Results of Evaluation | Ex. 1 | Ex. 2 | Ex. 3 | Ex. 4 | Ex. 5 |
|---|---|---|---|---|---|
| Core Type | C1 | C1 | C2 | C3 | C4 |
| Angle α (°) | 48.0 | 48.0 | 48.0 | 48.0 | 48.0 |
| Angle β (°) | 0.0 | 0.0 | 0.0 | 0.0 | −15.4 |
| Diff. (α − β) | 48.0 | 48.0 | 48.0 | 48.0 | 63.4 |
| Ratio (Y/X) | 0.6 | 0.6 | 0.6 | 0.6 | 0.6 |
| Ratio (Z/X) | 1.0 | 1.0 | 1.0 | 0.9 | 1.0 |
| Ratio (S2/S1) | 1.6 | 1.6 | 1.6 | 1.6 | 1.6 |
| Ratio (S3/S1) | 4.0 | 4.0 | 4.2 | 3.9 | 4.0 |
| Ratio (V2/V1) | 3.1 | 3.1 | 3.1 | 3.1 | 3.1 |
| Ratio (V3/V1) | 12.8 | 12.8 | 13.3 | 12.3 | 12.8 |
| Inner mid layer Form. | b | b | b | b | b |
| Tm1 (mm) | 1.0 | 1.0 | 1.0 | 1.0 | 1.0 |
| Hm1 (Shore D) | 70 | 70 | 70 | 70 | 70 |
| Outer mid layer Form. | c | e | c | c | c |
| Tm2 (mm) | 0.8 | 0.8 | 0.6 | 0.8 | 0.8 |
| Hm2 (Shore D) | 50 | 60 | 50 | 50 | 50 |
| Diff. (Hm1 − Hm2) | 20 | 10 | 20 | 20 | 20 |
| Sum (Tm1 + Tm2) | 1.8 | 1.8 | 1.6 | 1.8 | 1.8 |
| Cover Form. | A | A | A | A | A |
| Tc (mm) | 0.3 | 0.3 | 0.3 | 0.5 | 0.3 |
| Hc (Shore D) | 31 | 31 | 31 | 31 | 31 |
| Deformation Db (mm) | 2.3 | 2.3 | 2.3 | 2.3 | 2.3 |
| (W#1)Spin (rpm) | 2350 | 2200 | 2300 | 2400 | 2330 |
| (W#1)Speed (m/s) | 75.9 | 76.0 | 75.9 | 75.7 | 75.8 |
| (W#1)Flight (m) | 257.9 | 260.6 | 258.8 | 256.0 | 257.9 |
| (SW)Spin (rpm) | 2300 | 2200 | 2250 | 2450 | 2300 |
| (SW)Feel | 6.0 | 5.4 | 5.2 | 6.3 | 6.1 |

TABLE 13

| Configuration of Ball and Results of Evaluation | Ex. 6 | Ex. 7 | Ex. 8 | Ex. 9 | Ex. 10 |
|---|---|---|---|---|---|
| Core Type | C5 | C6 | C7 | C1 | C8 |
| Angle α (°) | 48.0 | 48.0 | 48.0 | 48.0 | 48.0 |
| Angle β (°) | −15.8 | 15.4 | 15.8 | 0.0 | 0.0 |
| Diff. (α − β) | 63.9 | 32.6 | 32.2 | 48.0 | 48.0 |
| Ratio (Y/X) | 0.6 | 0.6 | 0.6 | 0.6 | 0.6 |
| Ratio (Z/X) | 0.9 | 1.0 | 0.9 | 1.0 | 0.9 |
| Ratio (S2/S1) | 1.6 | 1.6 | 1.6 | 1.6 | 1.6 |
| Ratio (S3/S1) | 3.9 | 4.0 | 3.9 | 4.0 | 3.6 |
| Ratio (V2/V1) | 3.1 | 3.1 | 3.1 | 3.1 | 3.1 |
| Ratio (V3/V1) | 12.3 | 12.8 | 12.3 | 12.8 | 11.3 |
| Inner mid layer Form. | b | b | b | a | b |
| Tm1 (mm) | 1.0 | 1.0 | 1.0 | 1.0 | 1.2 |
| Hm1 (Shore D) | 70 | 70 | 70 | 65 | 70 |
| Outer mid layer Form. | c | c | c | e | c |
| Tm2 (mm) | 0.8 | 0.8 | 0.8 | 0.8 | 1.2 |
| Hm2 (Shore D) | 50 | 50 | 50 | 60 | 50 |

TABLE 13-continued

| Configuration of Ball and Results of Evaluation | Ex. 6 | Ex. 7 | Ex. 8 | Ex. 9 | Ex. 10 |
|---|---|---|---|---|---|
| Diff. (Hm1 − Hm2) | 20 | 20 | 20 | 5 | 20 |
| Sum (Tm1 + Tm2) | 1.8 | 1.8 | 1.8 | 1.8 | 2.4 |
| Cover Form. | A | A | A | A | A |
| Tc (mm) | 0.5 | 0.3 | 0.5 | 0.3 | 0.3 |
| Hc (Shore D) | 31 | 31 | 31 | 31 | 31 |
| Deformation Db (mm) | 2.3 | 2.3 | 2.3 | 2.3 | 2.3 |
| (W#1)Spin (rpm) | 2380 | 2380 | 2430 | 2400 | 2450 |
| (W#1)Speed (m/s) | 75.8 | 75.8 | 75.6 | 75.8 | 75.7 |
| (W#1)Flight (m) | 257.9 | 256.9 | 255.1 | 255.1 | 255.1 |
| (SW) Spin (rpm) | 2450 | 2350 | 2500 | 2300 | 2400 |
| (SW)Feel | 5.8 | 6.2 | 5.9 | 4.8 | 5.7 |

TABLE 14

| Configuration of Ball and Results of Evaluation | Ex. 11 | Ex. 12 | Ex. 13 | Ex. 14 | Ex. 15 |
|---|---|---|---|---|---|
| Core Type | C14 | C15 | C16 | C17 | C18 |
| Angle α (°) | 39.8 | 45.0 | 35.5 | 30.5 | 0.0 |
| Angle β (°) | 0.0 | 0.0 | 0.0 | 0.0 | 0.0 |
| Diff. (α − β) | 39.8 | 45.0 | 35.5 | 30.5 | 0.0 |
| Ratio (Y/X) | 0.8 | 1.0 | 1.4 | 1.7 | 0.6 |
| Ratio (Z/X) | 0.8 | 1.9 | 1.5 | 1.2 | 1.0 |
| Ratio (S2/S1) | 2.2 | 3.0 | 4.8 | 6.3 | 1.6 |
| Ratio (S3/S1) | 3.3 | 10.8 | 9.1 | 7.5 | 4.0 |
| Ratio (V2/V1) | 4.8 | 7.0 | 12.8 | 18.7 | 3.1 |
| Ratio (V3/V1) | 11.1 | 49.1 | 43.2 | 37.4 | 12.8 |
| Inner mid layer Form. | b | b | b | b | b |
| Tm1 (mm) | 1.0 | 1.0 | 1.0 | 1.0 | 1.0 |
| Hm1 (Shore D) | 70 | 70 | 70 | 70 | 70 |
| Outer mid layer Form. | c | c | c | c | c |
| Tm2 (mm) | 0.8 | 0.8 | 0.8 | 0.8 | 0.8 |
| Hm2 (Shore D) | 50 | 50 | 50 | 50 | 50 |
| Diff. (Hm1 − Hm2) | 20 | 20 | 20 | 20 | 20 |
| Sum (Tm1 + Tm2) | 1.8 | 1.8 | 1.8 | 1.8 | 1.8 |
| Cover Form. | A | A | A | A | A |
| Tc (mm) | 0.3 | 0.3 | 0.3 | 0.3 | 0.3 |
| Hc (Shore D) | 31 | 31 | 31 | 31 | 31 |
| Deformation Db (mm) | 2.3 | 2.3 | 2.3 | 2.3 | 2.3 |
| (W#1)Spin (rpm) | 2200 | 2250 | 2400 | 2350 | 2400 |
| (W#1)Speed (m/s) | 75.7 | 75.8 | 75.9 | 75.8 | 76.0 |
| (W#1)Flight (m) | 257.9 | 257.9 | 256.9 | 256.0 | 257.9 |
| (SW) Spin (rpm) | 2250 | 2350 | 2300 | 2280 | 2300 |
| (SW) Feel | 6.3 | 6.2 | 5.7 | 5.8 | 5.8 |

TABLE 15

| Configuration of Ball and Results of Evaluation | Ex. 16 | Ex. 17 | Ex. 18 | Ex. 19 | Ex. 20 |
|---|---|---|---|---|---|
| Core Type | C19 | C20 | C1 | C1 | C1 |
| Angle α (°) | 24.0 | 0.0 | 48.0 | 48.0 | 48.0 |
| Angle β (°) | 0.0 | −15.4 | 0.0 | 0.0 | 0.0 |
| Diff. (α − β) | 24.0 | 15.4 | 48.0 | 48.0 | 48.0 |
| Ratio (Y/X) | 0.6 | 0.6 | 0.6 | 0.6 | 0.6 |
| Ratio (Z/X) | 1.0 | 1.0 | 1.0 | 1.0 | 1.0 |
| Ratio (S2/S1) | 1.6 | 1.6 | 1.6 | 1.6 | 1.6 |
| Ratio (S3/S1) | 4.0 | 4.0 | 4.0 | 4.0 | 4.0 |
| Ratio (V2/V1) | 3.1 | 3.1 | 3.1 | 3.1 | 3.1 |
| Ratio (V3/V1) | 12.8 | 12.8 | 12.8 | 12.8 | 12.8 |
| Inner mid layer Form. | b | b | b | b | b |
| Tm1 (mm) | 1.0 | 1.0 | 0.4 | 0.8 | 1.0 |
| Hm1 (Shore D) | 70 | 70 | 70 | 70 | 70 |
| Outer mid layer Form. | c | c | c | c | c |
| Tm2 (mm) | 0.8 | 0.8 | 0.3 | 1.0 | 0.5 |
| Hm2 (Shore D) | 50 | 50 | 50 | 50 | 50 |
| Diff. (Hm1 − Hm2) | 20 | 20 | 20 | 20 | 15 |
| Sum (Tm1 + Tm2) | 1.8 | 1.8 | 0.7 | 1.8 | 1.8 |
| Cover Form. | A | A | A | A | A |

TABLE 15-continued

Configuration of Ball and Results of Evaluation

| | Ex. 16 | Ex. 17 | Ex. 18 | Ex. 19 | Ex. 20 |
|---|---|---|---|---|---|
| Tc (mm) | 0.3 | 0.3 | 0.3 | 0.3 | 0.6 |
| Hc (Shore D) | 31 | 31 | 31 | 31 | 31 |
| Deformation Db (mm) | 2.3 | 2.3 | 2.3 | 2.3 | 2.3 |
| (W#1)Spin (rpm) | 2450 | 2450 | 2200 | 2400 | 2300 |
| (W#1)Speed (m/s) | 75.8 | 76.0 | 76.0 | 75.8 | 75.9 |
| (W#1)Flight (m) | 256.0 | 257.9 | 260.6 | 255.1 | 258.8 |
| (SW) Spin (rpm) | 2300 | 2300 | 2250 | 2400 | 2250 |
| (SW) Feel | 5.9 | 6.1 | 5.4 | 6.6 | 5.3 |

TABLE 16

Configuration of Ball and Results of Evaluation

| | Ex. 21 | Ex. 22 | Comp. Ex. 1 | Comp. Ex. 2 | Comp. Ex. 3 |
|---|---|---|---|---|---|
| Core Type | C1 | C26 | C9 | C1 | C1 |
| Angle α (°) | 48.0 | 18.4 | 48.0 | 48.0 | 48.0 |
| Angle β (°) | 0.0 | 0.0 | 0.0 | 0.0 | 0.0 |
| Diff. (α − β) | 48.0 | 18.4 | 48.0 | 48.0 | 48.0 |
| Ratio (Y/X) | 0.6 | 0.6 | 0.6 | 0.6 | 0.6 |
| Ratio (Z/X) | 1.0 | 1.0 | 1.1 | 1.0 | 1.0 |
| Ratio (S2/S1) | 1.6 | 1.6 | 1.6 | 1.6 | 1.6 |
| Ratio (S3/S1) | 4.0 | 4.0 | 4.6 | 4.0 | 4.0 |
| Ratio (V2/V1) | 3.1 | 3.1 | 3.1 | 3.1 | 3.1 |
| Ratio (V3/V1) | 12.8 | 12.8 | 15.0 | 12.8 | 12.8 |
| Inner mid layer Form. | f | b | c | c | b |
| Tm1 (mm) | 1.0 | 1.0 | 1.0 | 1.0 | 1.0 |
| Hm1 (Shore D) | 80 | 70 | 50 | 50 | 70 |
| Outer mid layer Form. | b | c | — | b | d |
| Tm2 (mm) | 0.8 | 0.8 | — | 0.8 | 0.8 |
| Hm2 (Shore D) | 70 | 50 | — | 70 | 32 |
| Diff. (Hm1 − Hm2) | 15 | 20 | — | −20 | 38 |
| Sum (Tm1 + Tm2) | 1.8 | 1.8 | — | 1.8 | 1.8 |
| Cover Form. | A | A | A | A | B |
| Tc (mm) | 0.3 | 0.3 | 0.3 | 0.3 | 0.3 |
| Hc (Shore D) | 31 | 31 | 31 | 31 | 36 |
| Deformation Db (mm) | 2.2 | 2.3 | 2.3 | 2.3 | 2.3 |
| (W#1)Spin (rpm) | 2150 | 2350 | 2550 | 2250 | 2600 |
| (W#1)Speed (m/s) | 76.0 | 76.0 | 75.7 | 76.0 | 75.7 |
| (W#1)Flight (m) | 262.4 | 258.8 | 252.4 | 258.8 | 253.3 |
| (SW) Spin (rpm) | 2200 | 2200 | 2400 | 2100 | 2400 |
| (SW) Feel | 4.7 | 4.7 | 6.9 | 2.7 | 6.1 |

TABLE 17

Configuration of Ball and Results of Evaluation

| | Comp. Ex. 4 | Comp. Ex. 5 | Comp. Ex. 6 | Comp. Ex. 7 | Comp. Ex. 8 |
|---|---|---|---|---|---|
| Core Type | C10 | C11 | C12 | C13 | C20 |
| Angle α (°) | 24.0 | 24.0 | — | — | 41.2 |
| Angle β (°) | 34.6 | 35.3 | — | — | 61.2 |
| Diff. (α − β) | −10.6 | −11.4 | — | — | −20.0 |
| Ratio (Y/X) | 0.6 | 0.6 | — | — | 1.6 |
| Ratio (Z/X) | 1.0 | 0.9 | — | — | 1.2 |
| Ratio (S2/S1) | 1.6 | 1.6 | — | — | 5.8 |
| Ratio (S3/S1) | 4.0 | 3.9 | — | — | 7.8 |
| Ratio (V2/V1) | 3.1 | 3.1 | — | — | 16.6 |
| Ratio (V3/V1) | 12.8 | 12.3 | — | — | 37.7 |
| Inner mid layer Form. | b | b | b | b | b |
| Tm1 (mm) | 1.0 | 1.0 | 1.0 | 1.0 | 1.0 |
| Hm1 (Shore D) | 70 | 70 | 70 | 70 | 70 |
| Outer mid layer Form. | c | c | c | c | c |
| Tm2 (mm) | 0.8 | 0.8 | 0.8 | 0.8 | 0.8 |
| Hm2 (Shore D) | 50 | 50 | 50 | 50 | 50 |
| Diff. (Hm1 − Hm2) | 20 | 20 | 20 | 20 | 20 |
| Sum (Tm1 + Tm2) | 1.8 | 1.8 | 1.8 | 1.8 | 1.8 |
| Cover Form. | A | A | A | A | A |
| Tc (mm) | 0.3 | 0.5 | 0.3 | 0.3 | 0.5 |

TABLE 17-continued

Configuration of Ball and Results of Evaluation

| | Comp. Ex. 4 | Comp. Ex. 5 | Comp. Ex. 6 | Comp. Ex. 7 | Comp. Ex. 8 |
|---|---|---|---|---|---|
| Hc (Shore D) | 31 | 31 | 31 | 31 | 31 |
| Deformation Db (mm) | 2.3 | 2.3 | 2.3 | 2.3 | 2.4 |
| (W#1Spin (rpm) | 2300 | 2350 | 2450 | 2350 | 2100 |
| (W#1)Speed (m/s) | 75.4 | 75.2 | 75.1 | 75.4 | 74.8 |
| (W#1)Flight (m) | 252.4 | 250.5 | 246.9 | 251.5 | 251.5 |
| (SW) Spin (rpm) | 2300 | 2300 | 2300 | 2300 | 2250 |
| (SW) Feel | 5.8 | 5.9 | 5.8 | 5.9 | 5.8 |

TABLE 18

Configuration of Ball and Results of Evaluation

| | Comp. Ex. 9 | Comp. Ex. 10 | Comp. Ex. 11 | Comp. Ex. 12 |
|---|---|---|---|---|
| Core Type | C21 | C22 | C23 | C24 |
| Angle α (°) | 41.2 | 48.0 | 48.0 | −12.5 |
| Angle β (°) | 61.2 | 0.0 | 0.0 | −15.4 |
| Diff. (α − β) | −20.0 | 48.0 | 48.0 | 2.9 |
| Ratio (Y/X) | 1.6 | 0.6 | 0.6 | 0.6 |
| Ratio (Z/X) | 1.2 | 1.0 | 1.0 | 1.0 |
| Ratio (S2/S1) | 5.8 | 1.6 | 1.6 | 1.6 |
| Ratio (S3/S1) | 7.8 | 4.0 | 4.0 | 4.0 |
| Ratio (V2/V1) | 16.6 | 3.1 | 3.1 | 3.1 |
| Ratio (V3/V1) | 37.7 | 12.8 | 12.8 | 12.8 |
| Inner mid layer Form. | b | b | b | b |
| Tm1 (mm) | 1.0 | 1.0 | 1.0 | 1.0 |
| Hm1 (Shore D) | 70 | 70 | 70 | 70 |
| Outer mid layer Form. | c | c | c | c |
| Tm2 (mm) | 0.8 | 0.8 | 0.8 | 0.8 |
| Hm2 (Shore D) | 50 | 50 | 50 | 50 |
| Diff. (Hm1 − Hm2) | 20 | 20 | 20 | 20 |
| Sum (Tm1 + Tm2) | 1.8 | 1.8 | 1.8 | 1.8 |
| Cover Form. | A | A | A | A |
| Tc (mm) | 0.5 | 0.3 | 0.3 | 0.3 |
| Hc (Shore D) | 31 | 31 | 31 | 31 |
| Deformation Db (mm) | 2.4 | 2.3 | 2.3 | 2.3 |
| (W#1)Spin (rpm) | 2100 | 2300 | 2300 | 2350 |
| (W#1)Speed (m/s) | 74.8 | 75.3 | 75.3 | 75.2 |
| (W#1)Flight (m) | 251.5 | 251.5 | 251.5 | 249.6 |
| (SW) Spin (rpm) | 2250 | 2300 | 2300 | 2300 |
| (SW) Feel | 5.8 | 5.9 | 5.9 | 6.1 |

As shown in Tables 12 to 18, the golf ball of each Example achieves both excellent flight performance upon a shot with a driver and favorable feel at impact upon an approach shot. From the results of evaluation, advantages of the present invention are clear.

The golf ball according to the present invention can be used for playing golf on golf courses and practicing at driving ranges. The above descriptions are merely illustrative examples, and various modifications can be made without departing from the principles of the present invention.

What is claimed is:

1. A golf ball comprising a spherical core, a mid layer positioned outside the core, and a cover positioned outside the mid layer, wherein the core includes an inner core, a mid core positioned outside the inner core, and an outer core positioned outside the mid core, the mid layer includes an inner mid layer and an outer mid layer positioned outside the inner mid layer, a JIS-C hardness H(C) at a point C present outward from a boundary between the inner core and the mid core in a radius direction by 1 mm is equal to or greater than a JIS-C hardness H(B) at a point B present inward from the boundary between the inner core and the mid core in the radius direction by 1 mm, a JIS-C hardness H(E) at a point E present outward from a boundary between the mid core and the outer core in the radius direction by 1 mm is equal to or greater than a JIS-C hardness H(D) at a point D present inward from the boundary between the mid core and the outer core in the radius direction by 1 mm, when an angle (degree) calculated by (Formula 1) from a thickness Y (mm) of the mid core, the hardness H(C), and the hardness H(D) is defined as an angle α and an angle (degree) calculated by (Formula 2) from a thickness Z (mm) of the outer core, the hardness H(E), and a JIS-C hardness H(F) at a point F located on a surface of the core is defined as an angle β:

$$\alpha=(180°/\pi)*a\tan[\{H(D)-H(C)\}/Y] \quad \text{(Formula 1); and}$$

$$\beta=(180°/\pi)*a\tan[\{H(F)-H(E)\}/Z] \quad \text{(Formula 2),}$$

the angle α is equal to or greater than 0°, and a difference (α−β) between the angle α and the angle β is equal to or greater than 0°, a Shore D hardness Hm2 of the outer mid layer is less than a Shore D hardness Hm1 of the inner mid layer, and a Shore D hardness Hc of the cover is less than the hardness Hm2.

2. The golf ball according to claim 1, wherein the angle β is equal to or greater than −20° but equal to or less than +20°.

3. The golf ball according to claim 1, wherein a ratio (Y/X) of the thickness Y of the mid core relative to a radius X of the inner core is equal to or greater than 0.5 but equal to or less than 2.0, and a ratio (Z/X) of the thickness Z of the outer core relative to the radius X is equal to or greater than 0.5 but equal to or less than 2.5.

4. The golf ball according to claim 1, wherein a ratio (S2/S1) of a cross-sectional area S2 of the mid core relative to a cross-sectional area S1 of the inner core on a cut surface of the core that has been cut into two halves is equal to or greater than 1.0 but equal to or less than 8.0, and a ratio (S3/S1) of a cross-sectional area S3 of the outer core relative to the cross-sectional area S1 on the cut surface of the core is equal to or greater than 2.5 but equal to or less than 12.5.

5. The golf ball according to claim 1, wherein a ratio (V2/V1) of a volume V2 of the mid core relative to a volume V1 of the inner core is equal to or greater than 2.5 but equal to or less than 20.0, and a ratio (V3/V1) of a volume V3 of the outer core relative to the volume V1 is equal to or greater than 10.0 but equal to or less than 57.0.

6. The golf ball according to claim 1, wherein a difference (Hm1−Hm2) between the hardness Hm1 and the hardness Hm2 is equal to or greater than 10.

7. The golf ball according to claim 1, wherein a sum (Tm1+Tm2) of a thickness Tm1 of the inner mid layer and a thickness Tm2 of the outer mid layer is equal to or greater than 0.8 mm but equal to or less than 2.2 mm.

8. The golf ball according to claim 1, wherein a thickness Tm2 of the outer mid layer is smaller than a thickness Tm1 of the inner mid layer.

9. The golf ball according to claim 1, wherein a thickness Tc of the cover is smaller than a thickness Tm2 of the outer mid layer.

10. The golf ball according to claim 1, wherein the hardness Hm1 is equal to or greater than 55 but equal to or less than 80, and the hardness Hm2 is equal to or greater than 30 but equal to or less than 65.

* * * * *